US012702905B2

(12) United States Patent
Matthews et al.

(10) Patent No.: US 12,702,905 B2
(45) Date of Patent: Aug. 11, 2026

(54) GOLF CLUB HEAD WITH FLEXIBLE SOLE

(71) Applicant: KARSTEN MANUFACTURING CORPORATION, Phoenix, AZ (US)

(72) Inventors: Joshua B. Matthews, Phoenix, AZ (US); Eric J. Morales, Laveen, AZ (US); Erik M. Henrikson, Phoenix, AZ (US); Travis D. Milleman, Portland, OR (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 947 days.

(21) Appl. No.: 17/804,390

(22) Filed: May 27, 2022

(65) Prior Publication Data

US 2022/0288468 A1 Sep. 15, 2022

Related U.S. Application Data

(63) Continuation-in-part of application No. 17/088,440, filed on Nov. 3, 2020, now Pat. No. 11,731,011, which is a continuation of application No. 16/455,599, filed on Jun. 27, 2019, now Pat. No. 10,821,336.
(Continued)

(51) Int. Cl.
*A63B 53/04* (2015.01)

(52) U.S. Cl.
CPC ..... *A63B 53/0466* (2013.01); *A63B 53/0412* (2020.08); *A63B 53/0433* (2020.08); *A63B 53/045* (2020.08)

(58) Field of Classification Search
CPC ..... A63B 53/0466; A63B 53/0412; A63B 53/0433; A63B 53/045
See application file for complete search history.

(56) References Cited

U.S. PATENT DOCUMENTS 4,511,145 A 4/1985 Schmidt
5,080,366 A 1/1992 Okumoto et al.
(Continued)

FOREIGN PATENT DOCUMENTS

JP 0482574 3/1992
JP 5046672 10/2012
(Continued)

OTHER PUBLICATIONS

PCT International Search Report and Written Opinion dated Sep. 12, 2019 from corresponding PCT Application No. PCT/US2019/039618.

*Primary Examiner* — Michael D Dennis

(57) ABSTRACT

Described herein are embodiments of golf club heads with flexible soles. In one embodiment, the golf club head includes a body having a crown opposite a sole, a toe opposite a heel, a back end opposite a front end, and a hosel. The golf club head also includes a sole curvature profile comprising a radius of curvature that varies as the sole curvature profile extends between the front end and the back end. The golf club head further includes a negative draft angle and a substantially flat crown to increase the stiffness of the crown allows for maximum deformation of the sole. The radius of curvature of the sole is configured to increase the flexure of the entire golf club head, thereby increasing the internal energy of the golf club head.

18 Claims, 23 Drawing Sheets

Related U.S. Application Data

(60) Provisional application No. 63/202,123, filed on May 27, 2021, provisional application No. 62/861,247, filed on Jun. 13, 2019, provisional application No. 62/856,637, filed on Jun. 3, 2019, provisional application No. 62/690,858, filed on Jun. 27, 2018.

(56) References Cited

U.S. PATENT DOCUMENTS

| | | | | |
|---|---|---|---|---|
| 5,295,689 | A | 3/1994 | Lundberg | |
| 6,296,576 | B1 | 10/2001 | Capelli | |
| 6,964,617 | B2 | 11/2005 | Williams | |
| 7,056,229 | B2 | 6/2006 | Chen | |
| 7,066,835 | B2 | 6/2006 | Evans et al. | |
| 7,273,419 | B2 | 9/2007 | Evans et al. | |
| 7,399,237 | B2 | 7/2008 | Evans et al. | |
| 7,452,287 | B2 | 11/2008 | Erickson et al. | |
| 7,641,568 | B2 | 1/2010 | Hoffman et al. | |
| 7,651,410 | B2 | 1/2010 | Shimazaki | |
| 7,803,067 | B2 | 9/2010 | Horacek et al. | |
| 7,942,759 | B2 | 5/2011 | Matsunaga et al. | |
| 8,012,038 | B1 | 9/2011 | Beach et al. | |
| 8,353,784 | B2 | 1/2013 | Boyd et al. | |
| 8,360,900 | B2 | 1/2013 | Snyder | |
| 8,864,601 | B1 * | 10/2014 | Ehlers | A63B 60/00 473/345 |
| 8,986,131 | B2 | 3/2015 | Stites et al. | |
| 9,174,103 | B2 | 11/2015 | Curtis et al. | |
| 9,393,473 | B2 | 7/2016 | Knight | |
| 9,498,684 | B2 | 11/2016 | Motokawa | |
| 9,498,688 | B2 | 11/2016 | Galvan et al. | |
| 9,636,559 | B2 | 5/2017 | De La Cruz et al. | |
| 9,764,207 | B2 * | 9/2017 | Fossum | A63B 60/00 |
| 9,975,010 | B2 | 5/2018 | Saso | |
| 10,035,048 | B2 | 7/2018 | Stokke et al. | |
| 10,286,264 | B2 | 5/2019 | Makoto et al. | |
| 11,027,177 | B2 | 6/2021 | Jertson et al. | |
| 2003/0171162 | A1 | 9/2003 | Park | |
| 2003/0190975 | A1 | 10/2003 | Fagot | |
| 2004/0192463 | A1 | 9/2004 | Tsurumaki et al. | |
| 2005/0049081 | A1 | 3/2005 | Boone | |
| 2009/0124410 | A1 * | 5/2009 | Rife | A63B 53/0466 473/328 |
| 2011/0152004 | A1 | 6/2011 | Ban et al. | |
| 2011/0247190 | A1 * | 10/2011 | Evans | A63B 53/0466 29/407.01 |
| 2019/0201754 | A1 | 7/2019 | Hoffman | |
| 2020/0001146 | A1 * | 1/2020 | Morales | A63B 53/0466 |
| 2023/0390615 | A1 | 12/2023 | Morales et al. | |

FOREIGN PATENT DOCUMENTS

| | | |
|---|---|---|
| JP | 6474321 | 2/2019 |
| WO | 2018022789 A1 | 2/2018 |

* cited by examiner

GOLF CLUB HEAD WITH FLEXIBLE SOLE

CROSS-REFERENCE TO RELATED APPLICATIONS

This is a continuation-in-part of U.S. patent application Ser. No. 17/088,440, filed on Nov. 30, 2020, which is a continuation of U.S. patent application Ser. No. 16/455,599, filed on Jun. 27, 2019, now U.S. Pat. No. 10,821,336, issued Nov. 30, 2020, which claims the benefit of U.S. Provisional Patent Appl. No. 62/861,247, filed on Jun. 13, 2019, the benefit of U.S. Provisional Patent Appl. No. 62/856,637, filed on Jun. 3, 2019, and the benefit of U.S. Provisional Patent Appl. No. 62/690,858, filed on Jun. 27, 2018. This further claims the benefit of U.S. Provisional Patent Appl. No. 63/202,123, filed on May 27, 2021, the contents of which are incorporated fully herein by reference.

FIELD OF INVENTION

This disclosure relates generally to golf clubs and relates more particularly to golf club heads with flexible soles.

BACKGROUND

Wood-type golf club heads typically include a high strength metal faceplate attached to a hollow metal club body. When a wood-type club head impacts a golf ball, the travel distance of the ball is largely a function of the kinetic energy imparted from the club head to the ball. During impact, some of the energy is lost as a result of the collision. One measure of energy transfer from the club head to the golf ball is the Coefficient of Restitution ("COR"). Most of the energy is lost as a result of high stresses and deformations of the golf ball, as opposed to the relatively small deformations of the club head. To reduce the amount of energy lost during impact, and thus increase the energy transfer efficiency, the stresses and rate of deformation experienced by the golf ball during impact must be reduced.

One way to accomplish this is to allow more deformation of the club head during impact. For example, this can be achieved by increasing the flexure of the faceplate. Typical means of increasing faceplate flexure include uniform faceplate thinning, varying a thickness of the faceplate, providing ribbed stiffeners on the faceplate, utilizing lighter materials such as titanium, and providing forged, stamped, or machined metal faceplates as opposed to cast faceplates.

Another way to increase deformation of the club head during impact is to increase the deformation of the club head body. This can be achieved by altering the geometry of the club head body to have a radius of curvature between the front and back regions. Some prior art club heads have accomplished this by providing sole regions having increased camber outward between the front and the back of the club head. The increased camber outward distributes stresses across a broader area in the sole region, allowing the thickness of the sole region to be reduced to promote larger deformations. However, these prior art sole regions "bow out" toward the ground and away from a centerline of the club head. This results in a strikeface that resides higher off the ground at an address position, making it more difficult to achieve desirable contact at impact. There is a need in the art for a golf club head with significant camber in the sole that does not bow outward towards the ground at an address position, or other structures that provide optimal deformation of the golf club.

BRIEF DESCRIPTION OF THE DRAWINGS

FIG. 22 is a cross-sectional view of the golf club head of FIG. 23, taken along the YZ plane.

Figure 1:
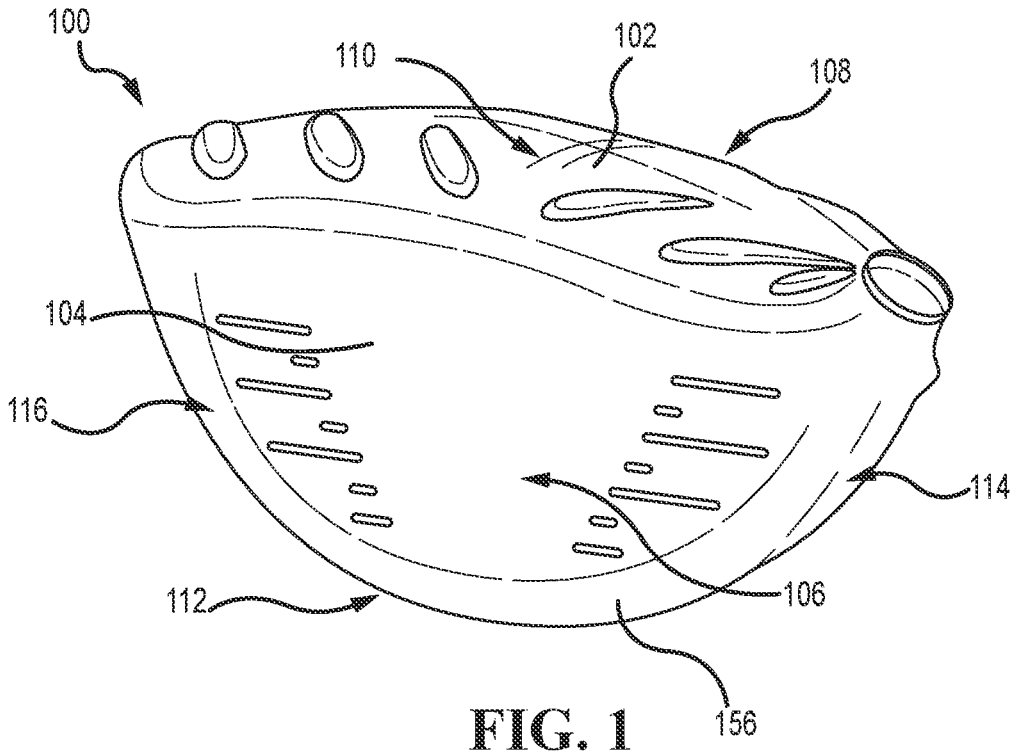
FIG. 1 is a front, heel-side perspective view of a golf club head.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf clubs and their methods of manufacture. The same reference numerals in different figures denote the same elements.

DETAILED DESCRIPTION

Described herein is a wood-type golf club head including a body having a reverse camber sole. Specifically, the sole of the club head includes an indented region, and the indented region includes a region of reversed concavity as compared to a concavity of remaining regions of the sole. The reverse camber sole follows a more tightly curved profile between a front end of the club head and a back end of the club head, as compared to prior art wood-type club heads. This promotes greater deflection in the sole of the body as the club head impacts a golf ball. The relatively greater deflection of the club body can yield higher internal energy of the club head as compared to prior art wood-type golf clubs. The higher the internal energy of the club head translates to farther traveling golf shots. In some embodiments, deflection of the sole can lead to an increase in internal energy of 1.0-10.0 lbf-inch. Additionally, the relatively greater deflection of the sole during impact can lead to a reduction in ball spin rate experienced by the golf ball upon impact with the club head.

In some embodiments, the club head described herein can also include one or more internal beams attached to the sole at a first end and at a second end and extending through an internal cavity of the golf club head between the first and second ends. The first end of each beam is attached to the sole at a location proximate the front end of the golf club head, and the second end of each beam is attached to the sole at or near the indented region. The internal beams further promote bending in the sole during impact with the golf ball, while reinforcing the sole to prevent failure.

In some embodiments, the club head described herein can also include a substantially flat crown having a negative draft angle. The flatness of the crown in comparison to prior art wood-type club heads forces a greater proportion of the deflection of the club head to occur in the sole. The increased deflection of the reverse camber sole during impact produces further increases in internal energy and/or reductions in ball spin rate.

In some embodiments, the club head described herein can also include one or more vibration damping ribs located on an internal surface of the sole. The one or more vibration damping ribs can serve to reduce the amplitude and/or increase the frequency of dominant vibrations that occur in the club head at impact. The vibration damping ribs can mitigate the undesirable vibrations occurring in the club head due to the tightly curved profile of the sole. The damping of said vibrations produces a club head with a more desirable sound and feel at impact.

In some embodiments, the club head described herein can also include a slot located extending through a portion of the sole. The slot creates a discontinuity in the sole that works in conjunction with the reverse camber sole to produce even an even greater increase in sole deflection and stored internal energy.

The various embodiments of the club head described herein can include any combination of the features described above or below. Any embodiment of the club head according to the present invention can include a reverse camber sole comprising an indented region, a substantially flat crown comprising a negative draft angle, one or more internal beams, one or more vibration damping ribs, a slot, or any combination thereof.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of golf clubs and methods of manufacture described herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of golf clubs and methods of manufacture described herein are, for example, capable of operation in other orientations than those illustrated or otherwise described herein. The term "coupled," as used herein, is defined as directly or indirectly connected in a physical, mechanical, or other manner.

Figure 15:
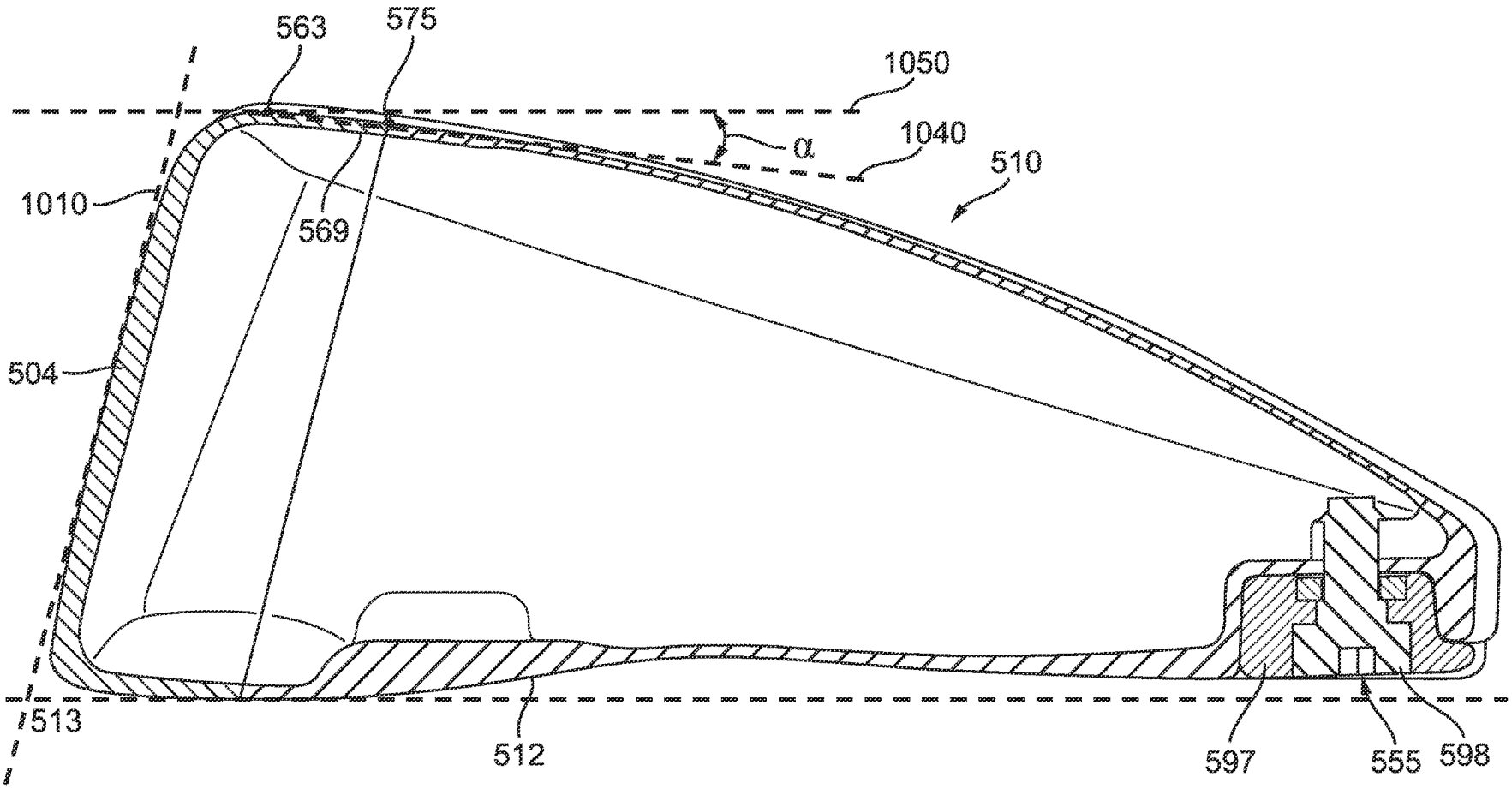
FIG. 15 is a cross-sectional view of the golf club head of FIG. 14, taken along the YZ plane, highlighting the draft angle of the crown.

The term "draft angle" as described herein is defined and as the acute angle formed between a crown return plane 1040 and a reference plane 1050 parallel to the ground plane 513 (as illustrated in FIG. 15). The draft angle characterizes the angle of a forward portion of the crown in relation to the sole. As illustrated in FIG. 15, the crown return plane 1040 extends through the crown transition point 563 and return transition point 575.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

FIGS. 1-4 illustrate an embodiment of a golf club head 100 having a flexible sole 112. The sole 112 is designed to camber inwards (away from a ground plane) and thereby increase the flexibility of the golf club head 100 upon impact with a golf ball. The increase in provides greater internal energy generated by the golf club head 100. This increase in internal energy increase the ball speed of a golf ball struck by golf club head 100. Increased ball speed directly translates late to farther traveling golf shots. The inward camber sole provides a 5-10 yards greater distance over a golf club head without the inward camber sole. The golf club head 100 can further comprise one or more stiffening beams 290 to moderate and control the flexibility of the golf club head 100.

I. Inward Camber Golf Club Head

FIGS. 1-4 illustrate a golf club head 100 having a body 102 and a strikeface 104. The body 102 of the club head 100 includes a front end 106, a back end 108 opposite the front end 106, a crown 110, the sole 112 opposite the crown 110, a heel 114, and a toe 116 opposite the heel 114. The sole 112 of the golf club head 100 comprises a ground plane 113, wherein the ground plane 113 is tangent to the sole 112 when the golf club head 100 is at an address position to strike a golf ball.

The club head 100 is a hollow body club head. The golf club head 100 comprises a body 102 and a strikeface 104. The body 102 and strikeface 104 define an internal cavity 118 (FIG. 4) of the golf club head 100. In the illustrated embodiment, the body 102 also defines the crown 110, the sole 112, the heel 114, the toe 116, the back end 108, a perimeter portion 120 (FIG. 3) of the front end 106 of the club head 100. These features can also define a hollow body. The perimeter portion 120 of the body 102 further defines an opening 122 at the front end 106 of the club head 100, and the strikeface 104 is coupled to the perimeter portion 120 to fill the opening 122, thereby forming the club head 100. In other embodiments (discussed in further detail below), the strikeface 104 can extend over the entire front end 106 of the club head and can include a return portion extending over at least one of the crown 110, the sole 112, the heel 114, and the toe 116. In such embodiments, the return portion of the strikeface 104 is coupled to the body 102 to form the club head 100.

Figure 3:
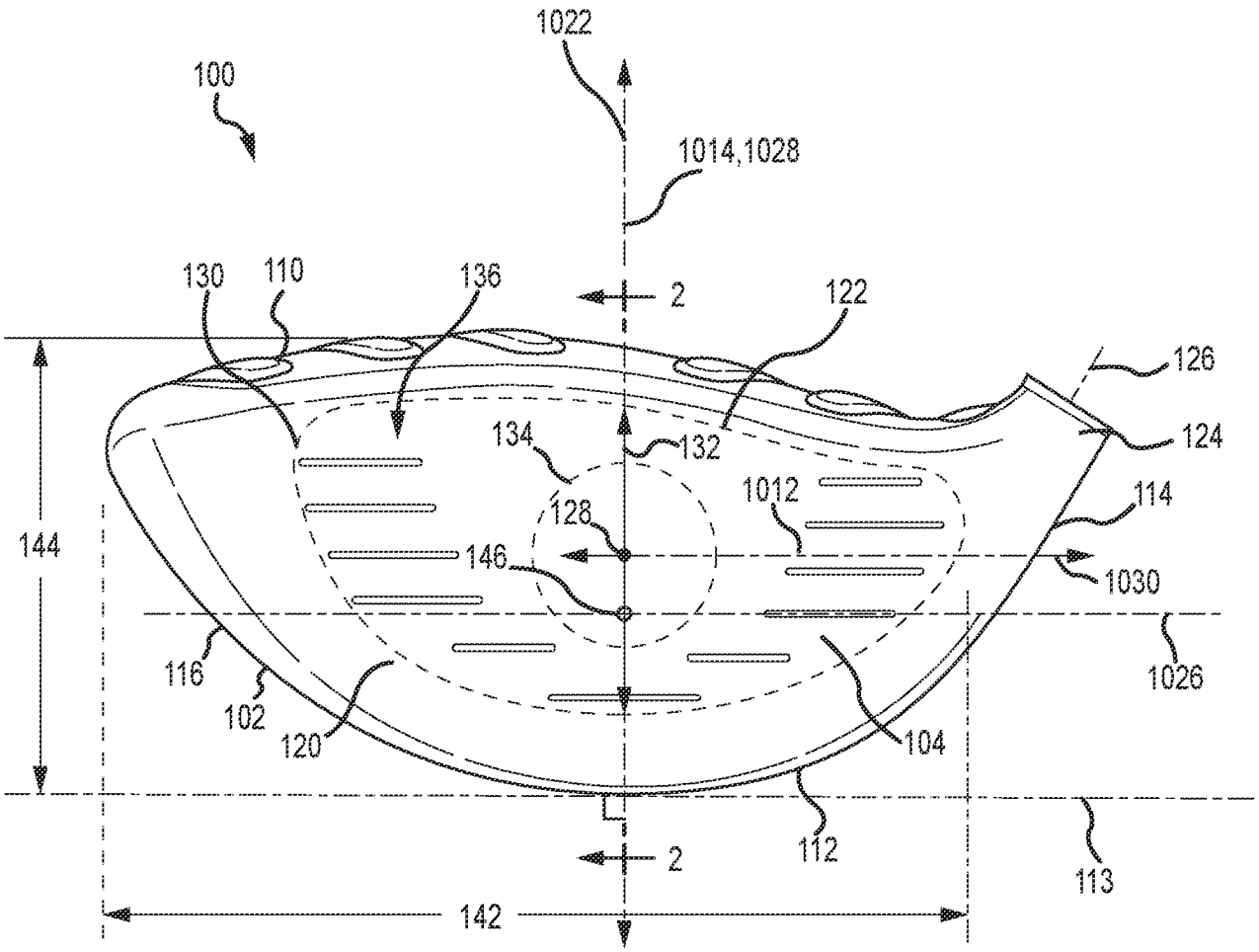
FIG. 3 is a front view of the golf club head of FIG. 1.

As shown in FIG. 3, the club head 100 further comprises a hosel structure 124 and a hosel axis 126 extending centrally along a bore of the hosel structure 124. The hosel structure 124 can be coupled to an end of a golf shaft (not shown). The golf shaft can be secured to the hosel structure 124 at a plurality of angles relative to the hosel axis 126. There can be other examples, however, where the shaft can be non-adjustably secured to the hosel structure 124.

Figure 4:
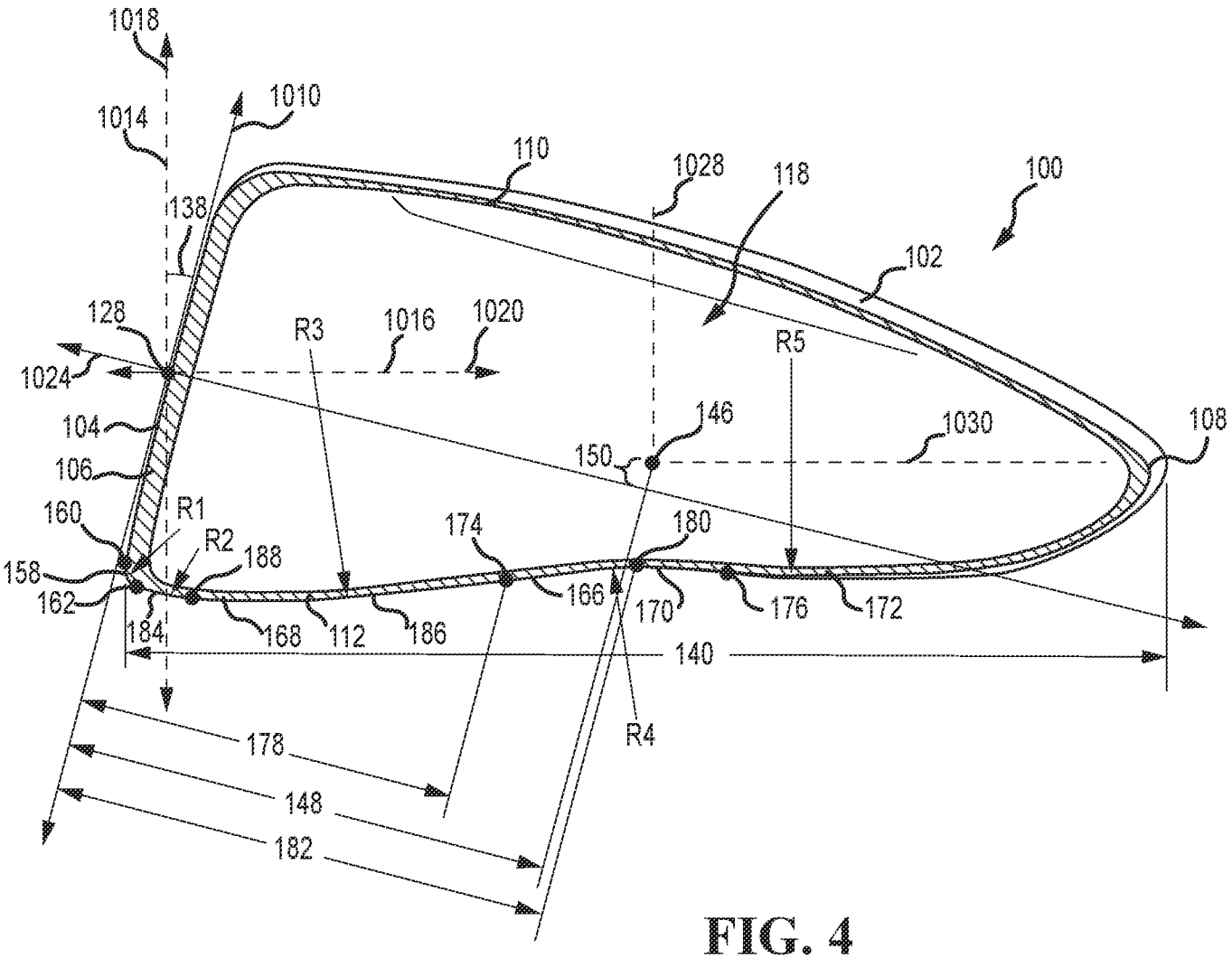
FIG. 4 is a cross-sectional view of the golf club head of FIG. 1, taken along a YZ plane as described herein.

The club head 100 defines a depth 140, a length 142, and a height 144. Referring to FIG. 4, the depth 140 of the club head 100 can be measured as the furthest extent of the club head 100 from the front end 106, to the back end 108, in a direction parallel to the Z axis 1016.

The length 142 of the club head 100 can be measured as the furthest extent of the club head 100 from the heel 114 to the toe 116, in a direction parallel to the X axis 1012, when viewed from the front view (FIG. 3). In many embodiments, the length 142 of the club head 100 can be measured according to a golf governing body such as the United States Golf Association (USGA). For example, the length 142 of the club head 100 can be determined in accordance with the USGA's Procedure for Measuring the Club Head Size of Wood Clubs (USGA-TPX3003, Rev. 2.1, Apr. 9, 2019).

The height 144 of the club head 100 can be measured as the furthest extent of the club head 100 from the crown 110 to the sole 112, in a direction parallel to the Y axis 1014, when viewed from the front view (FIG. 3). In many embodiments, the height 144 of the club head 100 can be measured according to a golf governing body such as the United States Golf Association (USGA). For example, the height 144 of the club head 100 can be determined in accordance with the USGA's Procedure for Measuring the Club Head Size of Wood Clubs.

In many embodiments, a volume (V) of the club head 100 is greater than approximately 140 cc, greater than approximately 150 cc, greater than approximately 175 cc, greater than approximately 200 cc, greater than approximately 225 cc, greater than approximately 250 cc, greater than approximately 275 cc, greater than approximately 300 cc, greater than approximately 325 cc greater than approximately 350 cc, greater than approximately 375 cc, greater than approximately 400 cc, greater than approximately 425 cc, greater than approximately 450 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc.

In many embodiments, the volume (V) of the club head can be approximately 140 cc-700 cc, In some embodiments, the volume of the club head can be between approximately 150 cc-175 cc, 175 cc-200 cc, 200 cc-225 cc, 225 cc-250 cc, 250 cc-275 cc, 275 cc-300 cc, 300 cc-325 cc, 325 cc-350 cc, 350 cc-375 cc, 375 cc-400 cc, 400 cc-425 cc, 425 cc-450 cc, 450 cc-475 cc, 475 cc-500 cc, 500 cc-525 cc, 525 cc-550 cc, 550 cc-575 cc, 575 cc-600 cc, 600 cc-625 cc, 625 cc-650 cc, 650 cc-675 cc, or 675 cc-700 cc.

With continued reference to FIG. 3, the strikeface 104 of the club head 100 defines a centerpoint or geometric center 128. In some embodiments, the geometric center 128 can be located at the geometric centerpoint of a strikeface perimeter 130, and at a midpoint of a face height 132. In the same or other examples, the geometric center 128 also can be centered with respect to an engineered impact zone 134, which can be defined by a region of grooves 136 on the strikeface 104. As another approach, the geometric center 128 of the strikeface 104 can be in accordance with the definition of a golf governing body such as the United States Golf Association (USGA). For example, the geometric center 128 of the strikeface 104 can be determined in accordance with Section 2.1 of the USGA's Procedure for Measuring the Flexibility of a Golf Clubhead (USGA-TPX3004, Rev. 2.0, Apr. 9, 2019).

With reference to FIGS. 3 and 4, the club head 100 further defines a loft plane 1010 tangent to the geometric center 128 of the strikeface 104. The face height 132 can be measured parallel to loft plane 1010 between a top end of the strikeface perimeter 130 near the crown 110 and a bottom end of the strikeface perimeter 130 near the sole 112.

The geometric center 128 of the strikeface 104 further defines a coordinate system of golf club head 100 has an origin located at the geometric center 128 of the strikeface 104. The coordinate system further comprises an X axis 1012, a Y axis 1014, and a Z axis 1016. The X axis 1012 extends through the geometric center 128 of the strikeface 104 in a direction from the heel 114 to the toe 116 of the club head 100. The Y axis 1014 extends through the geometric center 128 of the strikeface 104 in a direction from the crown 110 to the sole 112 of the club head 100 and is perpendicular to the X axis 1012. The Z axis 1016 extends through the geometric center 128 of the strikeface 104 in a direction from the front end 106 to the back end 108 of the club head 100 and is perpendicular to the X axis 1012 as well as the Y axis 1014.

The coordinate system defines an XY plane 1018 extending through the X axis 1012 and the Y axis 1014; an XZ plane 1020 extending through the X axis 1012 and the Z axis 1016; and a YZ plane 1022 extending through the Y axis 1014 and the Z axis 1016. The XY plane 1018, the XZ plane 1020, and the YZ plane 1022 are all perpendicular to one another and intersect at the origin of the coordinate system located at the geometric center 128 of the strikeface 104. The XY plane 1018 extends parallel to the hosel axis 126 and is positioned at an angle corresponding to a loft angle 138 of the club head 100 from the loft plane 1010. Further, the X axis 1012 is positioned at an approximately 60 degree angle to the hosel axis 126 when viewed from a direction perpendicular to the XY plane 1018 (i.e., as viewed in FIG. 4). In other embodiments, the X axis 1012 can be positioned at a 45-70 degree angle to the hosel axis 126 when viewed from a direction perpendicular to the XY plane 1018.

In these or other embodiments, the club head 100 can be viewed from a front view (e.g., as in FIG. 3) when the strikeface 104 is viewed from a direction perpendicular to the XY plane 1018. Further, in these or other embodiments, the club head 100 can be viewed from a side view or side cross-sectional view (e.g., as in FIG. 4) when the heel 114 is viewed from a direction perpendicular to the YZ plane 1022.

As shown in FIGS. 3 and 4, the club head 100 further comprises a head center of gravity (CG) 146 and a head depth plane 1024 extending through the geometric center 128 of the strikeface 104, perpendicular to the loft plane 1010, in a direction from the heel 114 to the toe 116 of the club head 100. In many embodiments, the head CG 146 is located at a head CG depth from the XY plane 1018, measured in a direction perpendicular to the XY plane 1018. In some embodiments, the head CG 146 can be located at a head CG depth 148 from the loft plane 1010, measured in a direction perpendicular to the loft plane 1010. The head CG 146 is further located at a head CG height 150 from the head depth plane 1024, measured in a direction perpendicular to the head depth plane 1024. Further, the head CG height 150 is measured as the offset distance from the head depth plane 1024 in a direction perpendicular to the head depth plane 1024 toward the crown 110 or toward the sole 112. In many embodiments, the head CG height 150 is positive when the head CG 146 is located above the head depth plane 1024 (i.e., between the head depth plane 1024 and the crown 110), and the head CG height 150 is negative when the head CG 146 is located below the head depth plane 1024 (i.e., between the head depth plane 1024 and the sole 112). In some embodiments, the absolute value of the head CG height 150 can describe a head CG 146 positioned above or below the head depth plane 1024 (i.e., between the head depth plane 1024 and the crown 110 or between the head depth plane 1024 and the sole 112). In many embodiments, the head CG 146 is strategically positioned toward the sole 112 and back end 108 of the club head 100.

The head CG 146 defines an origin of a coordinate system having an X' axis 1026, a Y' axis 1028, and a Z' axis 1030. The Y' axis 1028 extends through the head CG 146 from the crown 110 to the sole 112, parallel to the hosel axis 126 when viewed from the side view, and at a 30 degree angle from the hosel axis 126 when viewed from the front view (i.e., as viewed in FIG. 3). The X' axis 1026 extends through the head CG 146 from the heel 114 to the toe 116 and perpendicular to the Y' axis 1028 when viewed from a front view and parallel to the XY plane 1018. The Z' axis 1030 extends through the head CG 146 from the front end 106 to the back end 108 and perpendicular to the X' axis 1026 and the Y' axis 1028. In many embodiments, the X' axis 1026 extends through the head CG 146 from the heel 114 to the toe 116, and parallel to the X axis 1012. The Y' axis 1028 extends through the head CG 146 from the crown 110 to the sole 112 parallel to the Y axis 1014. The Z' axis 1030 extends through the head CG 146 from the front end 106 to the back end 108 and parallel to the Z axis 1016.

While the above examples may be described in connection with a wood-type golf club 100, the apparatus, methods, and articles of manufacture described herein may be applicable to a variety of types of golf clubs including drivers, fairway woods, hybrids, crossovers, or any hollow body type golf clubs.

The club head 100 further comprises a loft angle (not shown) measured as the angle between the loft plane 1010 and the ground plane 113. In many embodiments, the loft angle ranges between approximately 7 degrees and 40 degrees. In some embodiments, the loft angle of the club head 100 is less than approximately 16 degrees, less than approximately 15 degrees, less than approximately 14 degrees, less than approximately 13 degrees, less than approximately 12 degrees, less than approximately 11 degrees, or less than approximately 10 degrees.

In many embodiments, the loft angle of the club head 100 is less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the club head 100 is greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in some embodiments, the loft angle of the club head 100 can be between 12 degrees and 35 degrees, between 15 degrees and 35 degrees, between 20 degrees and 35 degrees, or between 12 degrees and 30 degrees.

In many embodiments, the loft angle of the club head 100 is less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the club head 100 is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

The strikeface 104 of the club head 100 is formed from a first material. In many embodiments, the first material can be a metal alloy, such as a titanium alloy (e.g., Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, HST-180, etc., or any combination thereof), a steel alloy (e.g., C300 steel, C350 steel, 455 steel, 431 steel, 475 steel, 565 steel, 17-4 stainless steel, maraging steel, Ni—Co—Cr steel alloy, etc.), an aluminum alloy, or any other metal or metal alloy. In other embodiments, the first material can be another material, such as a composite, plastic, thermoplastic composite, or any other suitable material or combination of materials.

The body 102 of the club head 100 is formed from a second material. In many embodiments, the first material can be a metal alloy, such as a titanium alloy (e.g., Ti 7-4, Ti 6-4, T-9S, Ti SSAT2041, Ti SP700, Ti 15-0-3, Ti 15-5-3, Ti 3-8-6-4-4, Ti 10-2-3, Ti 15-3-3-3, Ti-6-6-2, Ti-185, etc., or any combination thereof), a steel alloy (e.g., C300 steel, C350 steel, 455 steel, 431 steel, 475 steel, 565 steel, 17-4 stainless steel, maraging steel, Ni—Co—Cr steel alloy, etc.), an aluminum alloy, or any other metal or metal alloy. In other embodiments, the second material can be another material, such as a composite, plastic, or any other suitable material or combination of materials. In the illustrated embodiment, the second material differs from the first material. In other embodiments, the first and second materials can be the same.

In some embodiments, the body 102 can be formed of multiple materials. In some embodiments, the body can comprise both a metal portion, such as a metal alloy, and a non-metal portion, such as a plastic or composite, as described above. In some embodiments, the metal portion can comprise a majority of the sole 112, a portion of the heel 114, a portion of the toe 116, a portion of the crown 110, or any combination thereof. In some embodiments, the non-metal portion can comprise a portion of the crown 110, a portion of the heel 114, a portion of the toe 116, or any combination thereof. In some embodiments, a central portion of the crown 110 can be non-metal while a perimeter portion of the crown 110 can be metal. In other embodiments, the non-metal portion can comprise the entire crown 110. In other embodiments, the non-metal second portion can comprise the entire crown 110 and wrap around from the crown past the heel 114 and toe 116 and underneath the body 102 to form a part of the sole 112 near the heel 114 and toe 116. In some embodiments, the non-metal portion can comprise a substantial portion of the sole 112 or the entirety of the sole 112. In some embodiments, the non-metal portion can comprise a substantial portion of the sole 112 and a substantial portion of the crown 110. In some embodiments, the body 102 can be formed of the metal portion and can comprise one or more openings, on the crown 110, sole 112, heel 114 and/or toe 116 that can be covered by the non-metal portion.

II. Reverse Camber Sole

Figure 2:
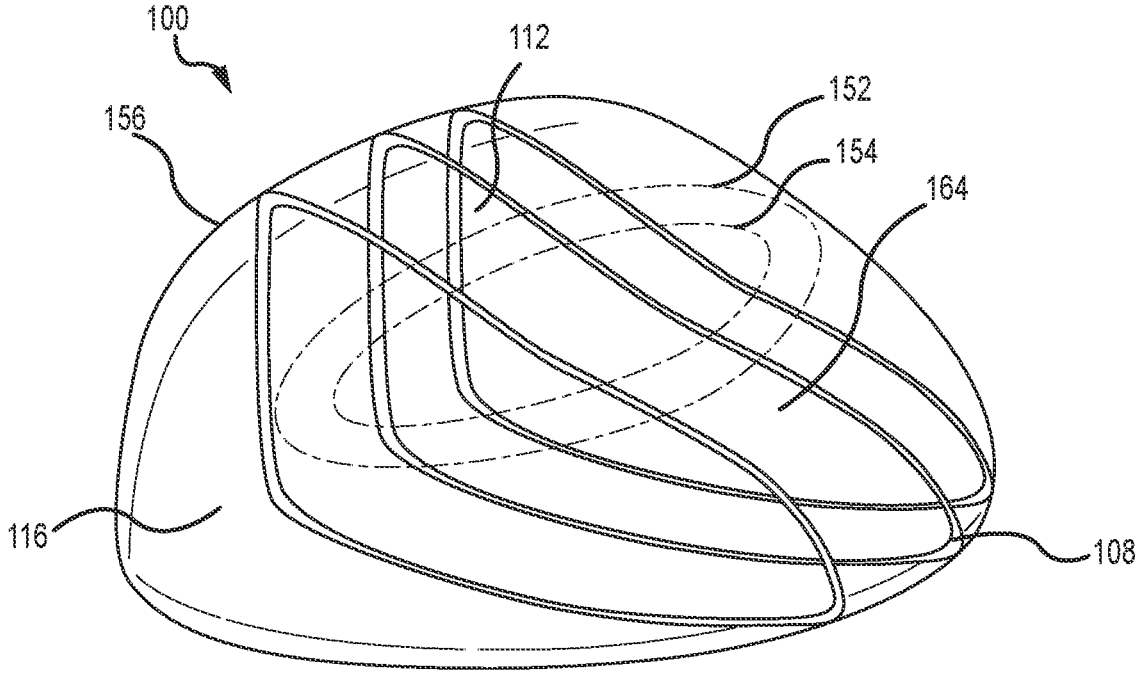
FIG. 2 is a back, crown-side perspective view of the golf club head of FIG. 1.

With reference to FIG. 2, the sole 112 of golf club head 100 further includes an indent or indented region 152 where the sole 112 veers inward in a direction toward the internal cavity 118 (FIG. 4). With respect to the XZ plane 1020 (FIG. 4), the indented region 152 includes a reverse camber region 154 that is convex relative to the XZ plane 1020. Typical prior art wood-type golf clubs include sole profiles that are only concave with respect to a comparable XZ plane. Accordingly, typical prior art wood-type golf clubs include sole profiles having relatively large radii of curvature between the front end and the back end (i.e., radii of curvature of around 22-25 inches). In contrast, the indented region 152 of the golf club head 100 allows the sole 112 to follow a much more tightly curved profile between the front end 106 and the back end 108. For example, in some embodiments of the club head 100, when viewed from a side cross-sectional view taken along the YZ plane 1022 (e.g., as viewed in FIG. 4), no portion of the sole 112 intersected by the YZ plane 1022 includes a radius of curvature greater than 10 inches between the front end 106 and the back end 108.

Moreover, in the illustrated embodiment of the club head 100, the sole 112 comprises substantially tight radii of curvature. In many embodiments, no portion of the sole 112 includes a radius of curvature greater than 12 inches when viewed from the side cross-sectional view taken along the YZ plane 1022. In some embodiments, no portion of the sole 112 includes a radius of curvature greater than 9 inches. In some embodiments, no portion of the sole 112 includes a radius of curvature greater than 6 inches. By implementing the indented region 152 into the sole 112, and thereby achieving relatively smaller radii of curvature of the sole 112 between the front and back ends 106 and 108, the club head body 102 experiences greater deformations in the sole 112 during impact with a golf ball. This results in an increase in the flexure of the golf club head 100 and more efficient energy transfer from the club head 100 to the ball during impact. The curvature of the sole 112 will be described in greater detail below.

With reference to FIG. 4, the club head 100 includes a face-sole transition boundary 156 (FIG. 2) where the front end 106 transitions to the sole 112. The face-sole transition boundary 156 extends between the front end 106 and the sole 112 from near the heel 114 to near the toe 116. A face-sole transition profile 158 is defined where the face-sole transition boundary 156 is intersected by the YZ plane 1022. That is, the face-sole transition profile 158 is the linear portion of the face-sole transition boundary 156 that is intersected by the YZ plane 1022, visible when viewed from a side cross sectional view taken along the YZ plane 1022 (e.g., as viewed in FIG. 4).

The face-sole transition profile 158 follows a face-sole transition radius of curvature R1. The face-sole transition profile 158 extends from a strikeface transition point 160, where a contour of the strikeface 104 departs from a roll radius of the strikeface 104, to a sole transition point 162, at which point the curvature of the sole 112 departs from the face-sole transition radius of curvature R1. The sole transition point 162 is defined by an intersection of the strikeface 104 and the sole 112. In some embodiments, the face-sole transition radius of curvature R1 comprises a constant radius of curvature extending from the strikeface transition point 160 to the sole transition point 162.

In some embodiments, the face-sole transition radius of curvature R1 can range from approximately 0.10 to 0.50 inches. For example, the face-sole transition radius of curvature R1 can be less than approximately 0.5 inches, less than approximately 0.475 inches, less than approximately 0.45 inches, less than approximately 0.425 inches, or less than approximately 0.40 inches. For further example, the face-sole transition radius of curvature R1 can be approximately 0.10 inches, 0.15 inches, 0.20 inches, 0.25 inches, 0.30 inches, 0.35 inches, 0.40 inches, 0.45 inches, or 0.50 inches.

With continued reference to FIG. 4, the sole 112 defines an exterior sole surface 164 (FIG. 2) extending from the front end 106 to the back end 108, and from the heel 114 to the toe 116. A sole curvature profile 166 of the club head 100 is defined as a linear extent of the sole surface 164 intersected by the YZ plane 1022 and extending from the sole transition point 162 to the back end 108. The sole curvature profile 166 includes a first concave section 168, a convex section 170, and a second concave section 172. The first concave section 168 extends from the sole transition point 162 to a first inflection point 174 and is concave relative to the XZ plane 1020 (convex relative to the ground plane 113). The first inflection point 174 is defined as a first point along the sole curvature profile 166 where, when following the sole curvature profile 166 from the front end 106 toward the back end 108, the sole curvature profile 166 reverses concavity with respect to the XZ plane 1020.

The convex section 170 of the sole curvature profile 166 extends from the first inflection point 174 to a second inflection point 176 and is convex relative to the XZ plane 1020 (concave relative to the ground plane 113). The second inflection point 176 is defined as a second point along the sole curvature profile 166 where, when following the sole curvature profile 166 from the front end 106 toward the back end 108, the sole curvature profile 166 reverses concavity with respect to the XZ plane 1020. The second concave section 172 of the sole curvature profile 166 extends from the second inflection point 176 to the back end 108 and is concave relative to the XZ plane 1020 (convex relative to the ground plane 113).

With continued reference to FIG. 4, the club head 100 further includes a first inflection point depth 178 measured along a direction perpendicular to the loft plane 1010 between the loft plane 1010 and the first inflection point 174. In many embodiments, the first inflection point depth 178 of the club head 100 is greater than 0.50 inches. In the illustrated embodiment, the first inflection point depth 178 is approximately 1.50 inches. In other embodiments, the first inflection point depth 178 of the club head 100 is greater than 0.75 inches, greater than 1.00 inches, greater than 1.10 inches, greater than 1.20 inches, greater than 1.30 inches, greater than 1.40 inches, greater than 1.50 inches, greater than 1.60 inches, greater than 1.70 inches, greater than 1.80 inches, greater than 1.90 inches, greater than 2.00 inches, greater than 2.25 inches, or greater than 2.50 inches. For example, in some embodiments, the first inflection point depth 178 of the club head 100 can be between 0.50-2.50 inches, between 1.00- 2.00 inches, between 1.25-1.75 inches, between 1.35-1.65 inches, or between 1.45-1.55 inches. In some embodiments, the first inflection point depth 178 of the club head 100 can be 0.50 inches, 0.75 inches, 1.0 inches, 1.25 inches, 1.50 inches, 1.75 inches, 2.00 inches, 2.25 inches, or 2.50 inches.

A first inflection point depth ratio of the club head 100 is defined as a ratio of the first inflection point depth 178 to the depth 140 of the club head 100. In many embodiments, the first inflection point depth ratio is greater than 0.25. In other embodiments, the first inflection point depth ratio is greater than 0.30, greater than 0.31, greater than 0.32, greater than 0.33, greater than 0.34, greater than 0.35, greater than 0.36, greater than 0.37, greater than 0.38, greater than 0.39, greater than 0.40, or greater than 0.45. For example, in some embodiments, the first inflection point depth ratio of the club head 100 can be between 0.25-0.45, between 0.30-0.45, between 0.25-0.40, between 0.30-0.40, between 0.32-0.38, or between 0.34-0.36. In some embodiments, the first inflection point depth ratio of the club head 100 can be 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, or 0.45.

With continued reference to FIG. 4, the sole 112 of the club head 100 further defines a nadir 180. The nadir 180 is located along a section of the sole curvature profile 166 that extends through the indented region 152 (FIG. 2). Specifically, the nadir 180 is defined as the point located on the sole curvature profile 166 within the indented region 152 and closest to the XZ plane 1020. In most embodiments, the nadir 180 is located on the convex section 170. In other words, the nadir 180 represents the lowest point of the indented region 152 as the indented region 152 extends toward the internal cavity 118.

The club head 100 further includes a nadir height (not shown) wherein the nadir height is measured perpendicularly from the ground plane 113 to the nadir 180. In many embodiments, the nadir height of the club head 100 ranges between 0.01 inches and 0.30 inches. In other embodiments, the nadir height of the club head 100 can range between 0.01-0.05 inches, 0.05-0.10 inches, 0.10-0.15 inches, 0.15-0.20 inches, 0.20-0.25 inches, or 0.25-0.30 inches. In other embodiments, the nadir height can be 0.01 inch, 0.02 inch, 0.03 inch, 0.04 inch, 0.05 inch, 0.06 inch, 0.07 inch, 0.08 inch, 0.09 inch, 0.10 inch, 0.11 inch, 0.12 inch, 0.13 inch, 0.14 inch, 0.15 inch, 0.16 inch, 0.17 inch, 0.18 inch, 0.19 inch, 0.20 inch, 0.21 inch, 0.22 inch, 0.23 inch, 0.24 inch, 0.25 inch, 0.26 inch, 0.27 inch, 0.28 inch, 0.29 inch, or 0.30 inch.

The club head 100 further includes a nadir depth 182 measured along a direction perpendicular to the loft plane 1010 between the loft plane 1010 and the nadir 180. In many embodiments, the nadir depth 182 of the club head 100 is greater than 1.0 inch. In other embodiments, the nadir depth 182 of the club head 100 is greater than 1.1 inches, greater than 1.2 inches, greater than 1.3 inches, greater than 1.4 inches, greater than 1.5 inches, greater than 1.6 inches, greater than 1.7 inches, greater than 1.8 inches, greater than 1.9 inches, greater than 2.0 inches, greater than 2.1 inches, greater than 2.2 inches, greater than 2.3 inches, greater than 2.4 inches, or greater than 2.5 inches. For example, in some embodiments, the nadir depth 182 of the club head 100 can be between 1.0-3.0 inches, between 1.0-1.5 inches, between 1.5-2.5 inches, between 2.0-3.0 inches, between 2.0-2.5 inches, or between 2.5-3.0 inches.

A nadir depth ratio of the club head 100 is defined as a ratio of the nadir depth 182 to the depth 140 of the club head 100. In many embodiments, the nadir depth ratio is greater than 0.35. In other embodiments, the nadir depth ratio is greater than 0.40, greater than 0.45, greater than 0.46, greater than 0.47, greater than 0.48, greater than 0.49, greater than 0.50, greater than 0.51, greater than 0.52, greater than 0.53, greater than 0.54, greater than 0.55, or greater than 0.60. For example, in some embodiments, the nadir depth ratio B of the club head 100 can be between 0.40-0.60, between 0.45-0.60, between 0.40-0.55, between 0.45-0.55, between 0.47-0.53, or between 0.49-0.51.

The sole curvature profile 166 of the club head 100 can also be described in terms of the radii of curvature along each of various sections of the sole curvature profile 166 between the front end 106 and the back end 108. With reference to FIG. 4, the first concave section 168 of the sole curvature profile 166 is divided into a first curvature section 184 having a first section radius of curvature R2, and a second curvature section 186 having a second section radius of curvature R3. The first curvature section 184 extends from the sole transition point 162 to a first concave section transition point 188, defined as a point along the sole curvature profile 166 where the first section radius of curvature R2 transitions to the second section radius of curvature R3. The second curvature section 186 extends from the first concave section transition point 188 to the first inflection point 174, which divides the second curvature section 186 from the convex section 170. The convex section 170 of the sole curvature profile 166 includes a convex section radius of curvature R4. Finally, the second concave section 172 includes a second concave section radius of curvature R5.

In some embodiments, the first section radius of curvature R2 can range from approximately 1.00 to 3.50 inches. In the illustrated embodiment, the first section radius of curvature R2 is approximately 1.75 inches. In other embodiments, the first section radius of curvature R2 can be less than 3.00 inches, less than 2.50 inches, less than 2.25 inches, less than 2.00 inches, or less than 1.75 inches. For example, the first section radius of curvature R2 may be approximately 1.00 inches, 1.25 inches, 1.5 inches, 1.75 inches, 2.00 inches, 2.25 inches, or 2.50 inches.

In some embodiments, the second section radius of curvature R3 can range from approximately 1.0 to 10.0 inches. In one embodiment, the second section radius of curvature R3 is approximately 6.0 inches. In other embodiments, the second section radius of curvature R3 can be less than 9.0 inches, less than 8.0 inches, less than 7.0 inches, less than 6.0 inches, less than 5.0 inches, less than 4.0 inches, less than 3.0 inches, or less than 2.0 inches. For example, the second section radius of curvature R3 may be approximately 3.0 inches, 4.0 inches, 5.0 inches, 6.0 inches, 7.0 inches, 8.0 inches, or 9.0 inches.

A nadir height ratio of the club head 100 is defined as the ratio of the nadir height to the radius of curvature R3 of the first concave section 168. The nadir height is inversely related to the radius of curvature R3. As the radius of curvature R3 decreases in magnitude, the nadir height increases. As the radius of curvature R3 increases in magnitude, the nadir height decreases. In many embodiments, the nadir height ratio is less than or equal to 0.33. In other embodiments, the nadir height ratio is less than 0.30, less than 0.25, less than 0.20, less than 0.15, less than 0.10, or less than 0.05. In other embodiments, the nadir height ratio can range between 0.001-0.05, 0.05-0.10, 0.10-0.15, 0.15-0.20, 0.20-0.25, 0.25-0.30, or 0.30-0.33.

In some embodiments, the convex section radius of curvature R4 can range from approximately 1.0 to 9.0 inches. In one embodiment, the convex section radius of curvature R4 is approximately 2.5 inches. In other embodiments, the convex section radius of curvature R4 can be less than 8.0 inches, less than 7.0 inches, less than 6.0 inches, less than 5.0 inches, less than 4.0 inches, less than 3.5 inches, less than 3.0 inches, or less than 2.5 inches. For example, the convex section radius of curvature R4 may be approximately 1.0 inches, 2.0 inches, 2.5 inches, 3.0 inches, 4.0 inches, 5.0 inches, 6.0 inches, 7.0 inches, 8.0 inches, or 9.0 inches. In one embodiment, the convex section radius of curvature R4 is approximately 2.0 inches.

In some embodiments, the second concave section radius of curvature R5 can range from approximately 5.0 to 15.0 inches. In the illustrated embodiment, the second concave section radius of curvature R5 is approximately 11.5 inches. In other embodiments, the second concave section radius of curvature R5 can be less than 12.0 inches, less than 11.0 inches, less than 10.0 inches, less than 9.0 inches, or less than 8.0 inches. For example, the second concave section radius of curvature R5 may be approximately 7.0 inches, 8.0 inches, 9.0 inches, 10.0 inches, 11.0 inches, 12.0 inches, or 13.0 inches. In some embodiments, the second concave section radius of curvature R5 can be between 5.0 and 7.0 inches, between 7.0 and 9.0 inches, between 9.0 and 11.0 inches, between 11.0 inches and 13.0 inches, or between 13.0 inches and 15.0 inches. In other embodiments, the sole curvature profile 166 of the club head 100 can also be defined by a polynomial equation, or quadratic equation.

The indented region 152 as described above allows the sole 112 of the club head 100 to follow a much more tightly curved profile between the front end 106 and the back end 108 as compared to prior art wood-type club heads. (i.e. a radius of curvature greater than 10 inches as the sole curvature profile extends between the front end and the back end). This promotes greater deflection in the sole 112 of the club body 102 as the club head 100 impacts a golf ball. The relatively greater deflection of the club body 102 can yield a higher flexure of the club head 100 as compared to traditional wood-type golf clubs.

The golf club head 100 can increase the internal energy generated at impact between 1.0-10.0 lbf-inch over a control club devoid of an indented region and/or a reverse camber sole. In some embodiments, the increase in internal energy generated at impact by golf club head 100 over the control club head can be greater than 1.0 lbf-inch, greater than 2.0 lbf-inch, greater than 3.0 lbf-inch, greater than 4.0 lbf-inch, greater than 5.0 lbf-inch, greater than 6.0 lbf-inch, greater than 7.0 lbf-inch, greater than 8.0 lbf-inch, greater than 9.0 lbf-inch, or greater than 10.0 lbf-inch. In some embodiments, the increase in internal energy generated at impact by golf club head 100 over the control club head can be between 1.0 lbf-inch and 4.0 lbf-inch, 2.0 lbf-inch and 5.0 lbf-inch, 3.0 lbf-inch and 6.0 lbf-inch, 4.0 lbf-inch and 7.0 lbf-inch, 5.0 lbf-inch and 8.0 lbf-inch, 6.0 lbf-inch and 9.0 lbf-inch, 7.0 lbf-inch and 10.0 lbf-inch.

This substantial increase in internal energy can lead to the ball speed increasing by greater than 0.1 mph, greater than 0.2 mph, greater than 0.3 mph, greater than 0.4 mph, greater than 0.5 mph, greater than 0.6 mph, greater than 0.7 mph, greater than 0.8 mph, greater than 0.9 mph, greater than 1.0 mph, greater than 1.1 mph, greater than 1.2 mph, greater than 1.3 mph, greater than 1.4 mph, or greater than 1.5 mph. In some embodiments, the increase in internal energy can lead to the ball speed increasing by between 0.1 mph and 0.5 mph, 0.2 mph and 0.6 mph, 0.3 mph and 0.7 mph, 0.4 mph and 0.8 mph, 0.5 mph and 0.9 mph, 0.6 mph and 1.0 mph, 0.7 mph and 1.1 mph, 0.8 mph and 1.2 mph, 0.9 mph and 1.3 mph, 1.0 mph and 1.4 mph, or mph and 1.5 mph, The increase in internal energy can lead to an increase in the travel distance of the golf ball between 1-10 yards. In some embodiments, the travel distance of a golf ball can increase greater than 1 yard, greater than 2 yards, greater than 3 yards, greater than 4 yards, greater than 5 yards, greater than 6 yards, greater than 7 yards, greater than 8 yards, greater than 9 yards, or greater than 10 yards. In some embodiments, the travel distance of the golf ball can be increased by between 1 yard and 3 yards, between 2 yards and 4 yards, between 3 yards and 5 yards, between 4 yards and 6 yards, between 5 yards and 7 yards, between 6 yards and 8 yards, between 7 yards and 9 yards, or between 8 yards and 10 yards.

Additionally, the relatively greater deflection of the sole 112 during impact can lead to a reduction in ball spin rate experienced by the golf ball upon impact with the club head 100. For example, the spin rate may be reduced by approximately 150 revolutions per minute (RPM). In some embodiments, the spin rate may be reduced by greater than 10 RPM, greater than 20 RPM, greater than 30 RPM, greater than 40 RPM, greater than 50 RPM, greater than 60 RPM, greater than 70 RPM, greater than 80 RPM, greater than 90 RPM, greater than 100 RPM, greater than 110 RPM, greater than 120 RPM, greater than 130 RPM, greater than 140 RPM, or greater than 150 RPM. In some cases, the ball spin rate may be reduced by greater than 160 RPM, greater than 170 RPM, greater than 180 RPM, greater than 190 RPM, or even greater than 200 RPM. In some embodiments, the spin rate may be reduced by between 10 RPM and 25 RPM, between 25 RPM and 50 RPM, between 50 RPM and 75 RPM, between 75 RPM and 100 RPM, between 100 RPM and 125 RPM, between 125 RPM and 150 RPM, between 150 RPM and 175 RPM, or between 175 RPM and 200 RPM.

III. Reverse Camber Sole and Internal Curved Beams

Figure 5:
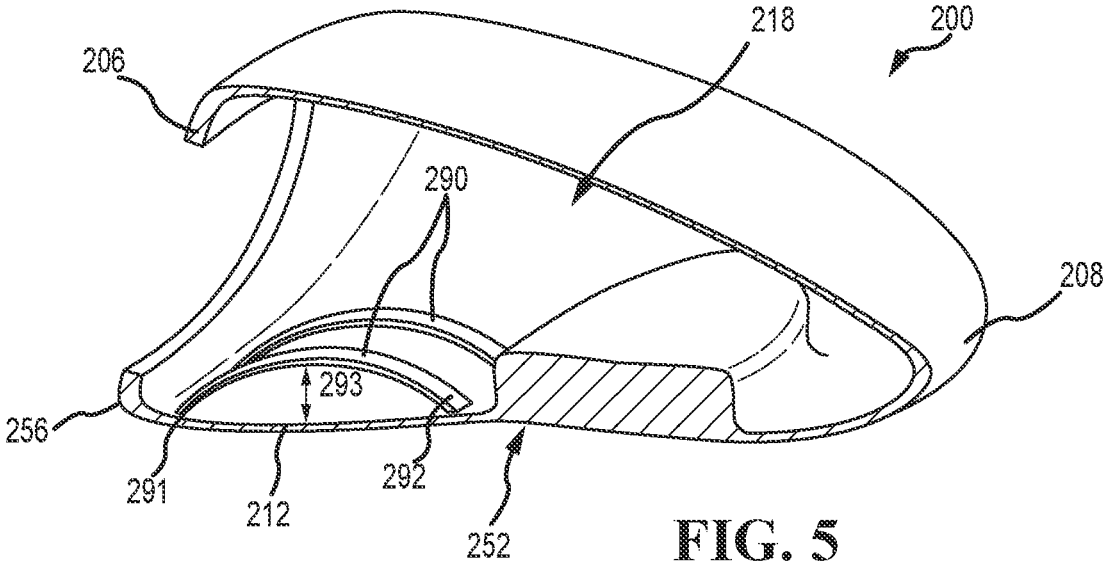
FIG. 5 is a perspective cross-sectional view of a golf club head, taken along the YZ plane.
Figure 6:
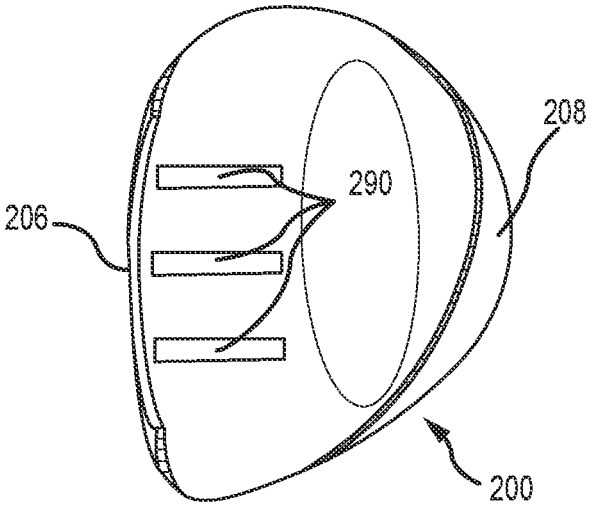
FIG. 6 is a top, cross-sectional view of the golf club head of FIG. 5.
Figure 7:
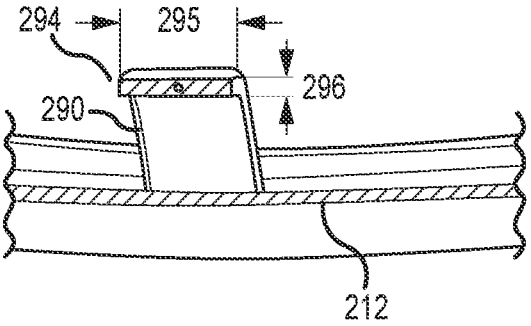
FIG. 7 is a detailed cross-sectional view of the golf club head of FIG. 5.

FIGS. 5-7 illustrate a golf club head 200 according to another embodiment of the invention. The golf club head 200 is similar to the golf club head 100 and includes substantially the same structure as the golf club head 100, but for the inclusion of one or more internal beams 290 attached to the sole 212 (described in further detail below). Accordingly, the following description focuses primarily on the structure and features that are different from the embodiments described above in connection with FIGS. 1-4. Features and elements that are described in connection with FIGS. 1-4 are numbered in the 200 series of reference numbers in FIGS. 5-7. It should be understood that the features of the golf club head 200 that are not explicitly described below have the same properties as the features of the golf club head 100.

Like the golf club head 100, the golf club head 200 includes an indented region 252 (FIG. 5) formed in the sole 212. With reference to FIGS. 5 and 6, the golf club head 200 also includes internal beams 290 attached to the sole 212 at a first end 291 and at a second end 292, and extending through the internal cavity 218 of the golf club head 200 between the first and second ends 291, 292. In the illustrated embodiment, the golf club head 200 includes three beams 290. In other embodiments, the golf club head 200 may include one, two, four, five, six, seven, eight, nine, or ten beams 290.

The first end 291 of each beam 290 is attached to the sole 212 at a location proximate the front end 206 of the golf club head 200. For example, in the illustrated embodiment, the first end 291 is attached to a portion of the sole 212 adjacent the face-sole transition boundary 256. The second end 292 of each beam 290 is attached to the sole 212 at or proximate to the indented region 252.

Each beam 290 extends generally in a front-to-back direction, or in a direction generally along the Z axis 1016. In some embodiments, each beam 290 follows a generally straight-line path between the first and second ends 291, 292. In the illustrated embodiment, each beam 290 follows a curvilinear path between the first and second ends 291, 292. Specifically, each beam 290 follows a generally arc-shaped path between the first end 291 and the second end 292. Further, in the illustrated embodiment, the beams 290 extend generally parallel to one another, and each beam 290 follows generally the same arc-shaped path. In other embodiments, the beams 290 can follow different respective paths, relative to one another, between the first and second ends 291, 292.

A beam height 293 of each beam 290 is defined as a maximum distance between the beam 290 and an internal surface of the sole 212, measured perpendicular to the internal surface of the sole. The beam height 293 can range from 0.010 inch to 1.000 inch. In some embodiments, the beam height 293 can range between 0.010-0.10 inch, 0.10-0.20 inch, 0.20-0.30 inch, 0.30-0.40 inch, 0.40-0.50 inch, 0.50-0.60 inch, 0.60-0.70 inch, 0.70-0.80 inch, 0.80-0.90 inch, or 0.90-1.0 inch. In some embodiments, the beam height 293 can be 0.10 inch, 0.20 inch, 0.30 inch, 0.40 inch, 0.50 inch, 0.60 inch, 0.70 inch, 0.80 inch, 0.90 inch, or 1.0 inch.

With reference to FIG. 7, each beam 290 includes a cross-sectional shape 294, defined where the beam 290 is intersected by a plane extending perpendicular to the path of the beam 290. In the illustrated embodiment, the cross-sectional shape 294 of each beam 290 is rectangular. In other embodiments, the cross-sectional shape 294 of each beam 290 may be circular, triangular, rectangular, trapezoidal, octagonal, or any other desirable cross-sectional shape.

In the illustrated embodiment, the cross-sectional shape 294 of each beam 290 includes a width 295, measured generally in a heel-toe direction, and a thickness 296, measured generally in a crown-sole direction. The width 295 can range from approximately 0.010 inch-1.000 inch. The width 295 can be 0.010 inch, 0.05 inch, 0.10 inch, 0.20 inch, 0.30 inch, 0.40 inch, 0.50 inch, 0.60 inch, 0.70 inch, 0.80 inch, 0.90 inch, or 1.0 inch. In the illustrated embodiment, the width 295 is approximately 0.2 inch.

The thickness 296 can range from approximately 0.010 inch-0.500 inch. In some embodiments, the thickness 296 can be 0.010 inch, 0.015 inch, 0.020 inch, 0.025 inch, 0.030 inch, 0.035 inch, 0.040 inch, 0.045 inch, or 0.050 inch. In the illustrated embodiment, the thickness 296 is approximately 0.033 inch. Moreover, each beam 290 is spaced from each adjacent beam by approximately 0.5 inch.

In other embodiments, the beams 290 may be spaced apart from one another by a distance ranging from 0.050 inch-1.000 inch. In some embodiments, the beams 290 can be spaced apart from one another by a distance of 0.010 inch, 0.015 inch, 0.020 inch, 0.025 inch, 0.030 inch, 0.035 inch, 0.040 inch, 0.045 inch, or 0.050 inch In some embodiments, the beams 290 can be formed from the same material as the body 204 of the club head 200 and can be integrally formed with the body 204. In other embodiments, the beams 290 can be formed separately from the body 204 and coupled to the body 204 with joining methods such as welding, epoxying, or any other suitable joining method. In these embodiments, the beams 290 can be formed from the same or a different material from the body 204 of the club head 200.

Figure 8:
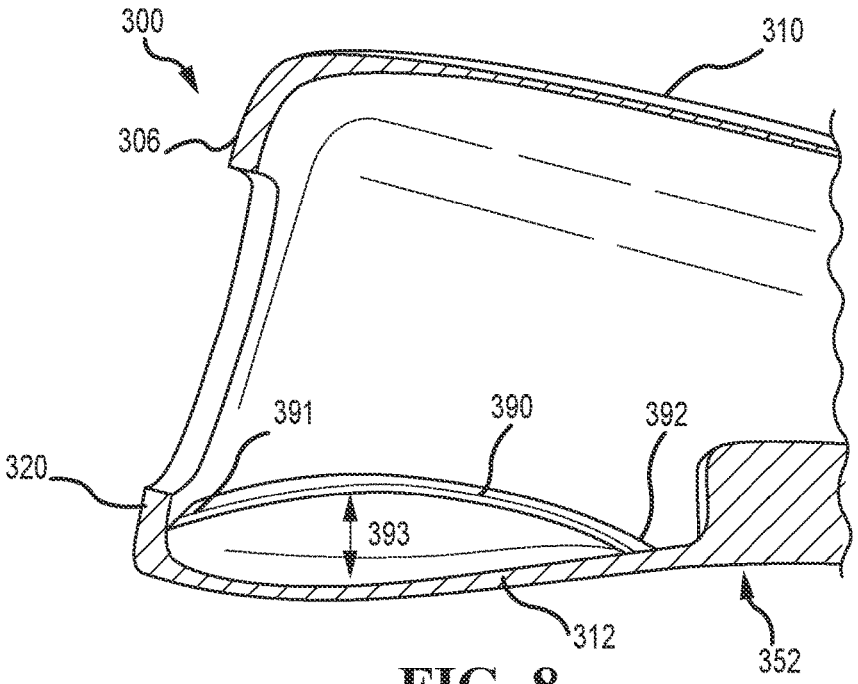
FIG. 8 is cross-sectional view of a portion of a golf club head, taken along the YZ plane.
Figure 9:
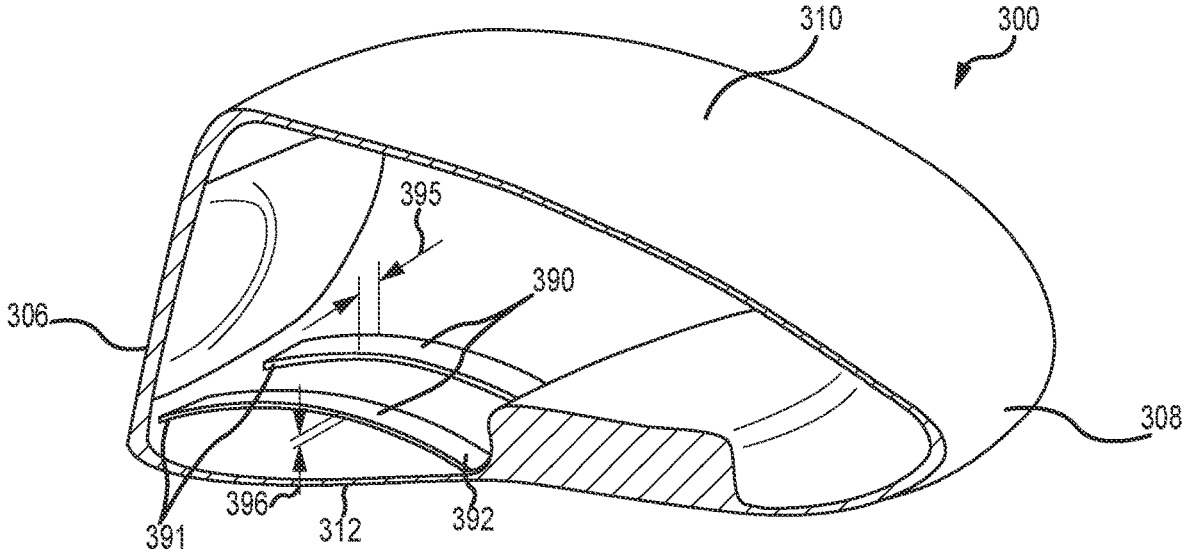
FIG. 9 is a perspective cross-sectional view of the golf club head of FIG. 8, taken along the YZ plane.

FIGS. 8 and 9 illustrate a golf club head 300 according to another embodiment of the invention. The golf club head 300 is similar to the golf club head 200 and includes substantially the same structure as the golf club head 200. Accordingly, the following description focuses primarily on the structure and features that are different from the embodiments described above in connection with FIGS. 5-7. Features and elements that are described in connection with FIGS. 5-7 are numbered in the 300 series of reference numbers in FIGS. 8 and 9. It should be understood that the features of the golf club head 300 that are not explicitly described below have the same properties as the features of the golf club head 200.

Like the golf club head 100 and 200, the golf club head 300 includes an indented region 352 formed in the sole 312. And, like the golf club head 200, the golf club head 300 includes internal beams 390 extending between a first end 391 and a second end 392. However, unlike the golf club head 200, the first ends 391 of the beams 390 of the club head 300 are not attached to the sole 312. Rather, the first end 391 of each beam 390 is attached to the front end 306. Specifically, the first end 391 of each beam 390 is attached to the perimeter portion 320 of the front end 306. Moreover, in the illustrated embodiment, the club head 300 includes four beams 390. In other embodiments, the club head 300 may include one, two, three, five, six, seven, eight, nine, or ten beams 290. The beams 390 of the club head 300 can follow any of the paths described above with respect to the club head 200. Likewise, the beams 390 can include a beam height 393, a cross-sectional shape 394, a width 395, and a thickness 396 similar to the beam height 293, the cross-sectional shape 294, the width 295, and the thickness 296 described above with respect to the club head 200.

IV. Reverse Camber Sole and Crown with Negative Draft Angle

Figure 14:
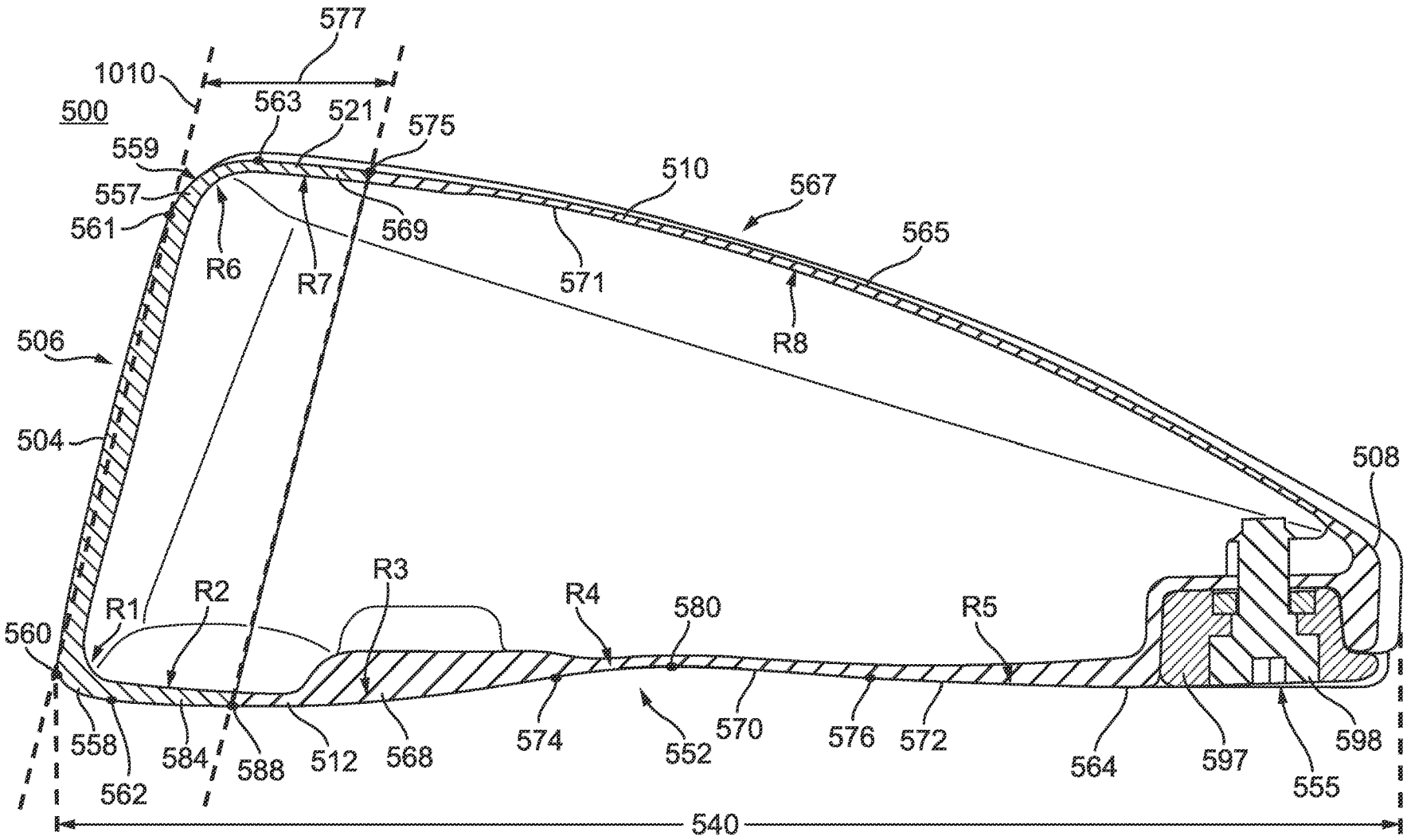
FIG. 14 is a cross-sectional view of a golf club head according to another embodiment, taken along the YZ plane.

FIGS. 14 and 15 illustrate an embodiment of a club head 500 including a reverse camber sole 512 in combination with a tight face-to-crown transition and a substantially flat crown 510 that encourage additional flexure in the sole 512. The golf club head 500 is similar to the golf club head 100 and includes substantially the same structure as the golf club head 100, but for the inclusion of the flat crown 510. Accordingly, the following description focuses primarily on the structure and features that are different from the embodiments described above in connection with FIGS. 1-4. Features and elements that are described in connection with FIGS. 1-4 are numbered in the 500 series of reference numbers in FIG. 14. It should be understood that the features of the golf club head 500 that are not explicitly described below have the same properties as the features of the golf club head 100.

Like the golf club head of previous embodiments, the golf club head 500 includes an indented region 552 formed in the sole 512. The golf club head 500 includes a strikeface 504 that extends over the entire front end 506 of the club head 500, wherein the strikeface 504 forms a return portion 521. The return portion 521 can extend over at least one of the crown 510, the sole 512, the heel 514, and the toe 516. In many embodiments, the club head 500 forms a "face cup" configuration, in which the return portion 521 extends rearward from the front end 506 and forms a portion of the crown 510, a portion of the sole 512, and a portion of the toe 516. In some embodiments, the strikeface 504 may not form a portion of the heel 514 or the hosel structure 524, and the return portion 521 may not extend rearward from the front end 506 on the heel side. The return portion 521 can be formed as an integral part of the strikeface 512. The strikeface 512, including the return portion 521 can comprise a material different than the remainder of the club head 500. In many embodiments, the strikeface 512 and return portion 521 can be formed of a high-strength material capable of sustaining repeated impacts with a golf ball. The inclusion of the return portion 521 can lead to increased durability of the club head 500 by providing a portion of the crown 510 with the high-strength strikeface 512 material and/or by moving the weld line between the strikeface 512 and the body 502 away from the front end 506 of the club head 500.

The crown 510 of golf club head 500 comprises a curvature defined by multiple radii of curvature between the front end 506 and the back end 508. The crown 510 of golf club head 500 can comprise radii of curvature that are relatively large in comparison to typical prior art golf club heads, providing a golf club head 500 with a substantially flat crown 510 comprising substantially large radii of curvature between 4.0 inches and 10.0 inches. The relatively large radii of curvature provide the crown 500 with a greater stiffness. During impact with a golf ball, the stiff crown 500 resists deformation and forces a greater portion of the club head deformation to occur in the sole 512. As mentioned above with respect to other embodiments, the increased deformation of the sole at impact leads to an increase in energy transfer between the club head 500 and the golf ball and/or a reduction in ball spin rate, especially on low face hits.

With continued reference to FIG. 14, the club head 500 includes a face-crown transition boundary 557 where the front end 506 transitions to the crown 510. The face-crown transition boundary 557 comprises a face-crown transition profile 559 visible when viewed from a cross sectional view taken along the YZ plane 1022 (e.g., as viewed in FIG. 14). The face-crown transition profile 559 follows a face-crown transition radius of curvature R6. The face-crown transition profile 559 extends from a strikeface-crown transition point 561, where a contour of the strikeface 504 departs from a roll radius of the strikeface 504, to a crown transition point 563, at which point the curvature of the crown 510 departs from the face-crown transition radius of curvature R6. In some embodiments, the face-crown transition radius of curvature R6 comprises a constant radius of curvature extending from the face-crown transition point 561 to the crown transition point 563. In many embodiments, the face-crown transition radius of curvature R6 can be substantially tight to provide an abrupt transition between the strikeface 504 and the crown 510. The tight face-crown transition radius of curvature R6 creates a substantially stiff interface between the strikeface 504 and the crown 510, which discourages deformation near the face-crown transition boundary 557. The stiffened face-crown transition boundary 557 in combination with the flat, rigid crown 510 influence a greater portion of the overall club head deformation to occur in the sole 512 by discouraging deformation at or near the crown 510.

In some embodiments, the face-crown transition radius of curvature R6 can range from approximately 0.1 to 0.50 inches. For example, the face-crown transition radius of curvature R6 can be less than approximately 0.5 inches, less than approximately 0.475 inches, less than approximately 0.45 inches, less than approximately 0.425 inches, or less than approximately 0.40 inches. For further example, the face-crown transition radius of curvature R6 can be approximately between 0.20 inches and 0.25 inches, 0.25 inches and 0.30 inches, 0.30 inches and 0.35 inches, 0.35 inches and 0.40 inches, 0.40 inches and 0.45 inches, or 0.45 inches and 0.50 inches.

With continued reference to FIG. 14, the crown 510 defines an exterior crown surface 565 extending from the front end 506 to the back end 508, and from the heel 514 to the toe 516. A crown curvature profile 567 of the club head 500 is defined as a linear extent of the crown surface 565 intersected by the YZ plane 1022 and extending from the crown transition point 563 to the back end 508. The crown curvature profile 567 includes a return section 569 and a crown section 571.

The return section 569 of the crown curvature profile 567 extends from the crown transition point 563 to a return transition point 575. The return transition point 575 is defined as the point along the crown curvature profile 567 where the return portion 521 is coupled to the body 502. The return transition point 575 separates the return section 569 from the remainder of the crown 510. The return transition point 575 comprises a return transition point depth 577 measured along a direction perpendicular to the loft plane 1010 between the loft plane 1010 and the return transition point 575.

In many embodiments, the return transition point depth 577 can be between approximately 0.25 inches and 1.0 inches. In the illustrated embodiment, the return transition point depth 577 is approximately 0.50 inches. In other embodiments, the return transition point depth 577 can be between approximately 0.25 and 0.30 inches, between approximately 0.30 and 0.40 inches, between approximately 0.40 and 0.50 inches, between approximately 0.50 and 0.60 inches, between approximately 0.60 and 0.70 inches, between approximately 0.70 and 0.80 inches, between approximately 0.80 and 0.90 inches, or between approximately 0.90 and 1.0 inches. In some embodiments, the return transition point depth 577 can be greater than 0.25 inches, greater than 0.30 inches, greater than 0.35 inches, greater than 0.40 inches, greater than 0.45 inches, greater than 0.50 inches, greater than 0.55 inches, greater than 0.60 inches, greater than 0.65 inches, greater than 0.70 inches, greater than 0.75 inches, greater than 0.80 inches, greater than 0.85 inches, greater than 0.90 inches, greater than 0.95 inches, or greater than 1.0 inch.

A return transition point depth ratio of the golf club head 500 is defined as the ratio of the return transition point depth 577 to the overall depth 540 of the golf club head 500. The return transition point depth ratio characterizes the proportion of the crown 510 formed by the return section 569. In many embodiments, the return transition point depth ratio can range from between approximately 0.05 to approximately 0.35. In the illustrated embodiment, the return transition point depth ratio is approximately 0.15 inches. In other embodiments, the return transition point depth ratio can be between approximately 0.05 and 0.10 inches, between approximately 0.10 and 0.15 inches, between approximately 0.15 and 0.20 inches, between approximately 0.20 and 0.25 inches, between approximately 0.25 and 0.30 inches, or between approximately 0.30 and 0.35 inches. In some embodiments, the return transition point depth ratio can be greater than 0.05 inches, greater than 0.10 inches, greater than 0.15 inches, greater than 0.20 inches, greater than 0.25 inches, greater than 0.30 inches, or greater than 0.35 inches.

In many embodiments, the crown section 571 of the crown curvature comprises the remainder of the crown not comprising the return section 569. The crown section 571 of the crown curvature profile 567 extends from the return transition point 575 to the back end 508 of the club head 500.

The crown curvature profile 567 of the club head 500 can be described in terms of the radii of curvature along each of various sections of the crown curvature profile 567 between the front end 506 and the back end 508. The return section 569 can comprise a return section radius of curvature R7. In some embodiments, the crown section 571 can comprise a single crown section radius of curvature R8. In other embodiments, the crown section 571 can comprise multiple radii of curvature along the crown curvature profile 567. The return section radius of curvature R7 and the crown section radius of curvature R8 characterize how flat or bulbous (or rounded) the crown 510 is. A flatter crown 510 corresponds to a greater return section radius of curvature R7 and/or a greater crown section radius of curvature R8, while a more bulbous crown corresponds to a smaller return section radius of curvature R7 and/or a smaller crown section radius of curvature R8. The substantially flat crown 510 of club head 500 comprises relatively large radii of curvature R7, R8.

In some embodiments, the return section radius of curvature R7 can range from approximately 4.0 to 10.0 inches. In the illustrated embodiment, the return section radius of curvature R7 is approximately 6.0 inches. In many embodiments, the return section radius of curvature R7 can be between approximately 4.5 inches and 7.0 inches. In other embodiments, the return section radius of curvature R7 can be between approximately 4.0 and 5.0 inches, between approximately 5.0 and 6.0 inches, between approximately 6.0 and 7.0 inches, between approximately 7.0 and 8.0 inches, between approximately 8.0 and 9.0 inches, or between approximately 9.0 and 10.0 inches. In some embodiments, the return section radius of curvature R7 can be greater than 4.0 inches, greater than 5.0 inches, greater than 6.0 inches, greater than 7.0 inches, greater than 8.0 inches, greater than 9.0 inches, or greater than 10.0 inches.

In some embodiments, crown section radius of curvature R8 can be substantially similar to return section radius of curvature R7, such that the curvature of the entire crown 510 is relatively uniform. The crown section radius of curvature R8 can range from approximately 4.0 to 10.0 inches. In the illustrated embodiment, the crown section radius of curvature R8 is approximately 6.0 inches. In some embodiments, the crown section radius of curvature R8 can be between approximately 4.5 inches and 7.0 inches. In other embodiments, the crown section radius of curvature R8 can be between approximately 4.0 and 5.0 inches, between approximately 5.0 and 6.0 inches, between approximately 6.0 and 7.0 inches, between approximately 7.0 and 8.0 inches, between approximately 8.0 and 9.0 inches, or between approximately 9.0 and 10.0 inches. In some embodiments, the crown section radius of curvature R8 can be greater than 4.0 inches, greater than 5.0 inches, greater than 6.0 inches, greater than 7.0 inches, greater than 8.0 inches, greater than 9.0 inches, or greater than 10.0 inches. In other embodiments, the return section radius of curvature R7 and the crown section radius of curvature R8 can be different from one another.

As discussed above, the golf club head 500 comprises a flat, stiff crown 510 and an indented, flexible sole 512 with tight curvatures. The disparity between the stiffness of the crown 510 and the flexibility of the sole 512 causes a large proportion of the flexure of the club head 500 at impact to occur in the sole 512, increasing energy transfer between club head 500 and the golf ball. In many embodiments, the disparity between the stiffness of the crown 510 and the flexibility of the sole 512 can be characterized by the relationship between the curvatures of each. In many embodiments, one or more radii of curvature of the crown 510 can be greater than one or more radii of curvature of the sole 512.

In general, the club head 500 comprises greater radii of curvature on the crown 510 than on the sole 512, producing a crown 510 that is much flatter in comparison to the sole 512. The difference between the crown 510 curvature and the sole 512 curvature can be characterized by a ratio comparing the crown section radius of curvature R8 to the convex section radius of curvature R4. In many embodiments, the ratio R8/R4 can be between 2.0 and 5.0. In some embodiments, the ratio R8/R4 can be between 2.0 and 2.5, between 2.5 and 3.0, between 3.0 and 3.5, between 3.5 and 4.0, between 4.0 and 4.5, or between 4.5 and 5.0. In some embodiments, the ratio R8/R4 can be greater than 2.0, greater than 2.5, greater than 3.0, greater than 3.5, greater than 4.0, greater than 4.5, or greater than 5.0. In many embodiments, the ratio R8/R4 can be approximately 2.0, approximately 2.5, approximately 3.0, approximately 3.5, approximately 4.0, approximately 4.5, or approximately 5.0.

In many embodiments, the forward-most portion of the crown 510 (i.e. the return portion 521) can comprise a much tighter curvature than the forward-most portion of the sole 512 (i.e. the first curvature section 584). The difference between the curvatures of the return portion 521 and the first curvature section 584 encourages additional bending to occur in the sole 512. The difference between the curvatures of the return portion 521 and the first curvature section 584 can be characterized by a ratio comparing the return section radius of curvature R7 to the first section radius of curvature R2. In many embodiments, the ratio R7/R2 can be between 2.0 and 5.0. In some embodiments, the ratio R7/R2 can be between 2.0 and 2.5, between 2.5 and 3.0, between 3.0 and 3.5, between 3.5 and 4.0, between 4.0 and 4.5, or between 4.5 and 5.0. In some embodiments, the ratio R7/R2 can be greater than 2.0, greater than 2.5, greater than 3.0, greater than 3.5, greater than 4.0, greater than 4.5, or greater than 5.0. In some embodiments, the ratio R7/R2 can be approximately 2.0, approximately 2.5, approximately 3.0, approximately 3.5, approximately 4.0, approximately 4.5, or approximately 5.0.

Referring to FIG. 15, the golf club head 500 can define a draft angle $\alpha$ measured between the crown 510 and the sole 512. The draft angle $\alpha$ characterizes the angle of the return portion 521 of the crown 510 relative to the sole 512. In many embodiments, the draft angle α can be negative, wherein the crown return portion 521 is angled downward towards the sole 512. In alternative embodiments, the draft angle α can be positive, wherein the crown return portion 521 is angled upwards and away from the sole 512. The draft angle α corresponds to the overall curvature of the crown 510. In general, a positive, high draft angle corresponds to a bulbous crown (wherein the crown is more rounded and comprises a relatively small radius of curvature). If the return portion 521 comprises a high draft angle α and is angled away from the sole 512, the crown 510 must comprise a tight radius of curvature in order for the rear of the crown 510 to connect to the back end 508. In general, a low or negative draft angle α corresponds to a flat crown 510. If the return portion 521 comprises a low or negative draft angle α and is angled down toward the sole 512, the crown 510 does not need to comprise a tight radius of curvature in order to connect to the back end 508.

In many embodiments, the club head 500 comprises a negative draft angle α that creates a flatter crown. Most prior art club heads comprise positive draft angles. In many embodiments, the draft angle α of the present club head 500 can range between 0 and −10 degrees. In the illustrated embodiment, the draft angle α is approximately −5 degrees. In other embodiments, the draft angle α can be approximately between 0 and −1 degrees, between −1 and −2 degrees, between −2 and −3 degrees, between −3 and −4 degrees, between −4 and −5 degrees, between −5 and −6 degrees, between −7 and −8 degrees, between −8 and −9 degrees, or between −9 and −10 degrees. In many embodiments, the draft angle α can be less than 0 degrees, less than −1 degrees, less than −2 degrees, less than −3 degrees, less than −4 degrees, less than −5 degrees, less than −6 degrees, less than −7 degrees, less than −8 degrees, less than −9 degrees, or less than −10 degrees. In many embodiments, the draft angle α can be approximately −2.5 degrees, approximately −3 degrees, approximately −3.5 degrees, approximately −4.0 degrees, approximately −4.5 degrees, approximately −5.0 degrees, approximately −5.5 degrees, approximately −6.0 degrees, approximately −6.5 degrees, approximately −7.0 degrees, or approximately −7.5 degrees.

In many embodiments, the draft angle α within the disclosed range contributes to the increased stiffness of the crown 510 by allowing the crown 510 to be substantially flat. If the draft angle α is increased drastically, the crown 510 must be provided with a more bulbous shape with a tighter curvature to connect the strikeface 504 to the back end 508. By providing a stiffened crown 510 with a negative draft angle α, a greater portion of the overall deformation of the golf club head 500 is forced to occur in the sole 512. The combination of a tight face-crown transition radius of curvature R6, a substantially flat crown 510 with a negative draft angle α, and an indented sole 512 allows for maximum deformation at the sole 512 during impact, which leads to increased internal energy at impact and/or lower ball spin rates.

In many embodiments, referring now to FIG. 14, the club head 500 can further comprise a rear weight member 597 configured to work in conjunction with the curvatures of the club head 500 to increase launch angle and/or ball speed. As illustrated by FIG. 14, the club head 500 can comprise a rear weight recess 555 located on the sole 512 and proximate the back end 508. The rear weight recess 555 can be recessed into the exterior sole surface 564 at or near the back end 508. In some embodiments, the rear weight recess 555 can directly abut the back end 508. In other embodiments, the rear weight recess 555 can be located in a rear portion of the sole 512, but may be offset from the back end 508 slightly. In some embodiments, the rear weight recess 555 can be offset from the back end 508 by between 0.05 inch and 1.0 inch. In some embodiments, the rear weight recess 555 can be offset from the back end 508 by between 0.05 inch and 0.10 inch, between 0.10 inch and 0.20 inch, between 0.20 inch and 0.30 inch, between 0.30 inch and 0.40 inch, between 0.40 inch and 0.50 inch, between 0.50 inch and 0.60 inch, between 0.60 inch and 0.70 inch, between 0.70 inch and 0.80 inch, between 0.80 inch and 0.90 inch, or between 0.90 inch and 1.0 inch.

The rear weight recess 555 is configured to receive a rear weight member 597. The rear weight member 597 can comprise a material different than the material of sole 512. In many embodiments, the rear weight member 597 comprises a density greater than that of the sole 512 in order to concentrate mass in a low and rearward location of the club head 500. The inclusion of the weight member 597 provides a CG 546 position that is closer to the sole 512 and the back end 508.

In many embodiments, the rear weight member 597 can be secured to the club head 500 via a mechanical fastener 598 that extends through an aperture (not shown) of the rear weight member 597 and secures to one or more surfaces of the rear weight recess 555. In many embodiment, the rear weight member 597 can be secured within the rear weight recess 555 by any other various mechanical fastening means, adhesive means, welding, or any other suitable joining method.

As discussed above, the rear weight member 597 in combination with the indented sole 512 can lead to increases in launch angle and ball speed. At impact, the sole 512 flexes and bends inward about the nadir 580. The flexure of the sole 512 causes the entire club head 500 to "fold in" on itself slightly, with the nadir 580 acting as the crease in the fold. As such, both the front end 506 and the back end 508 rotate downward (i.e. bend and rotate down towards the ground plane 513) about the nadir 580. The downward rotation of the back end 508 lowers the position of the rear weight member 597 with respect to the CG 546. In essence, the combination of the indented sole 512 and the rear weight member 597 dynamically lowers the CG 546 at impact, influencing a higher launch.

The increased launch angle created by said dynamic lowering of the CG 546 at impact is advantageous in producing golf shots that travel further by up to 5 yards. Additionally, the increased launch angle created by the dynamic lowering of the CG 546 at impact can allow the club head 500 to be designed with a reduced loft angle without causing the ball to launch too low. In general, reducing the loft angle of the designed club head 500 provides an increase in ball speed. Further, the increased launch angle created by the dynamic lowering of the CG 546 at impact can counteract the undesirable low launch that occurs on a golf shots struck low on the strikeface 504, which is a common mis-hit when using a fairway wood-type golf club head.

V. Reverse Camber Sole and Vibration Damping Ribs

FIGS. 16-20 illustrate a golf club head 600 according to another embodiment of the invention, comprising a plurality of vibration damping ribs 631. The vibration damping ribs 631 control the vibrations experienced by the club head 600 at impact and provide the club head 600 with a more desirable acoustic response. The vibration damping ribs 631 can be provided to reduce the amplitude and/or increase the frequency of undesirable vibrations created by the tight curvature of the sole 612. The golf club head 600 is similar to the golf club head 500 and includes substantially the same structure as the golf club head 500, but for the inclusion of one or more vibration damping ribs 631. Accordingly, the following description focuses primarily on the structure and features that are different from the embodiments described above in connection with FIGS. 14-15. Features and elements that are described in connection with FIG. 14-15 are numbered in the 600 series of reference numbers in FIGS. 16-20. It should be understood that the features of the golf club head 600 that are not explicitly described below have the same properties as the features of the golf club head 500. The vibration damping ribs 631 described herein can be combined with any of the crown 610 or sole 612 curvatures, the negative draft angle α, the return portion 621 described above, or any combination thereof.

Figure 16:
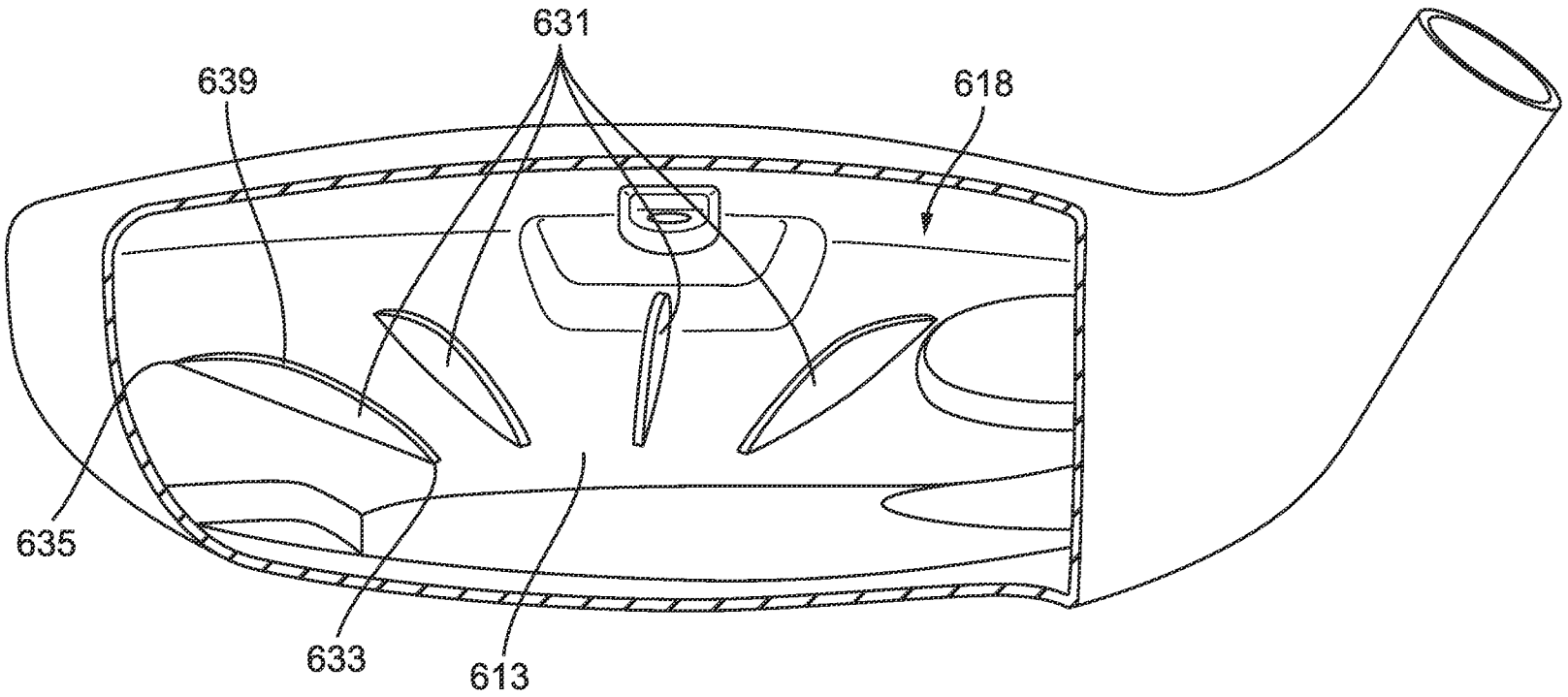
FIG. 16 is a front perspective front perspective view of a golf club head according to another embodiment, with the strikeface removed.

Like the golf club head 500, the golf club head 600 includes an indented region 652 formed in the sole 612, a return portion 621, and substantially negative draft angle α. With reference to FIG. 16, the golf club head 600 also includes a plurality of vibration damping ribs located on an internal surface 615 of the sole 612. The vibration damping ribs 631 allow the vibrational response of the golf club head 600 at impact to be controlled. The vibration damping ribs 631 can serve to reduce the amplitude of dominant modes of vibration occurring in the club head 600 and/or raise the frequency of said dominant modes. Controlling the vibrations of the golf club head 600 provides a club head 600 with a more desirable acoustic response at impact that is more pleasing to the ear.

As illustrated by FIG. 16, the vibration damping ribs 631 protrude upward from the sole interior surface 613 into the internal cavity 618. Each vibration damping rib 631 comprises a first end 633 and a second end 635 opposite the first end 633. In some embodiments, one or more of the plurality of vibration damping ribs 631 can define an arcuate shape such that the height of the rib 631 varies from the first end 633 to the second end 635. In many embodiments, as illustrated by FIG. 16, each vibration damping rib 631 can comprise an apex 639 between the first end 633 and the second end 635. In some embodiments, the height of each vibration damping rib 631 can be minimal near the first end 633 and/or the second end 635. In many embodiments, the vibration damping ribs 631 are integrally formed with the sole internal surface 615. In other embodiments, the vibration damping ribs 631 can be formed separately from the club head 600 and attached to the sole internal surface 615.

Figure 17:
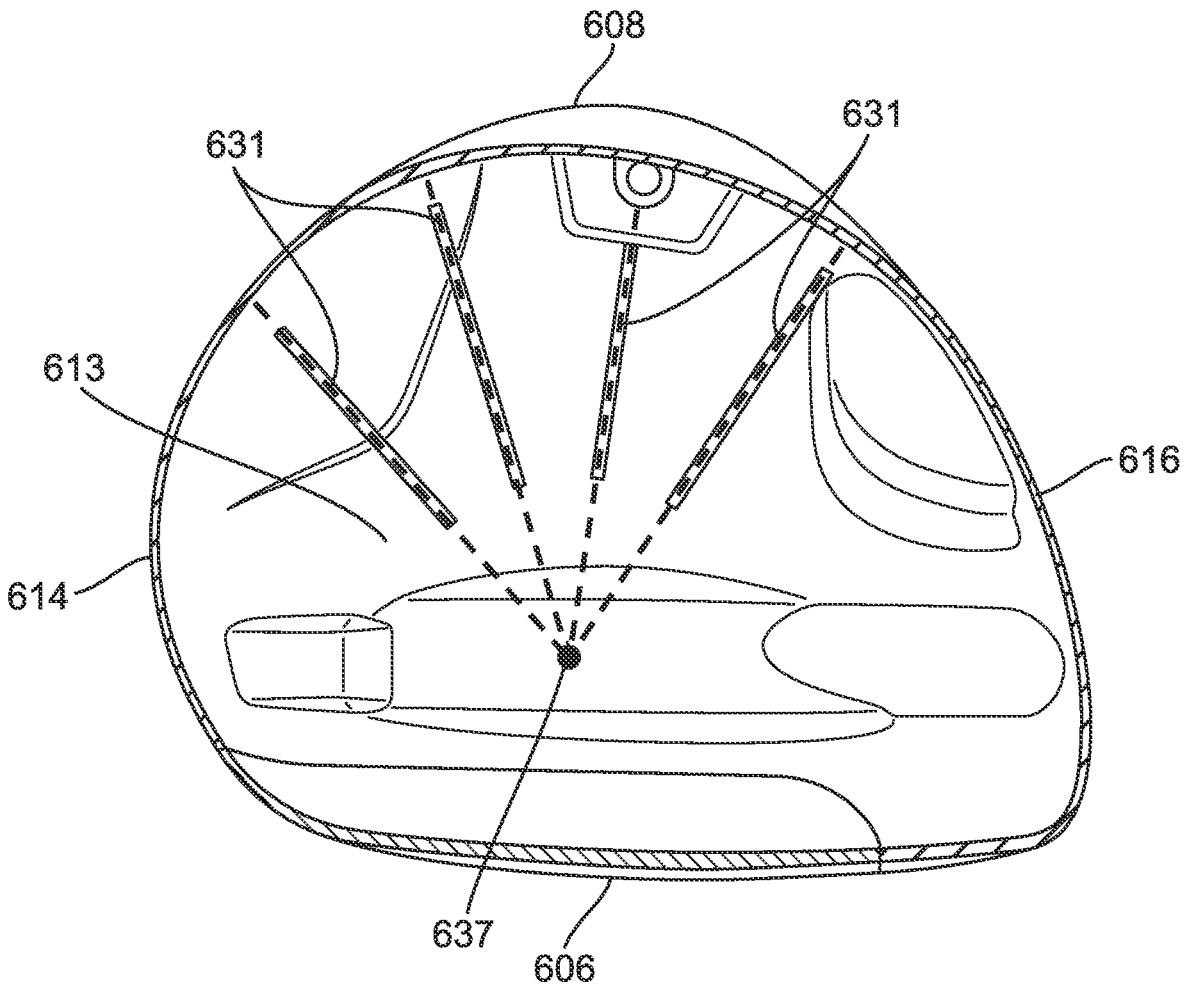
FIG. 17 is a top, cross-sectional view of the golf club head of FIG. 16, highlighting the orientation of a plurality of vibration damping ribs.

The configuration and location of the plurality of vibration damping ribs 631 along the internal surface 615 of the sole 612 can control both the amplitude and frequency of the dominant modes of vibration experienced by the club head 600 at impact. Referring to FIG. 17, in a first embodiment, the plurality of vibration damping ribs 631 can be arranged in a substantially radial pattern. In some embodiments, the plurality of vibration damping ribs 631 can radiate from a convergence point 637. In such embodiments, the vibration damping ribs 631 can extend from the convergence point 637 rearward towards the back wall 608 in different directions.

In some embodiments, the plurality of vibration damping ribs 631 can contact one another, such that the first end 633 of each rib 631 connects at the convergence point 637. In other embodiments, such as the illustrated embodiment of FIG. 17, the plurality of vibration damping ribs 631 do not contact one another, such that the first end 633 of each rib 631 is spaced away from the convergence point 637. In other embodiments (not shown), the plurality of vibration damping ribs 631 may not form a radial pattern. In some embodiments, one or more of the plurality of vibration damping ribs 631 can extend in a substantially front-end-to-rear-end direction, in a substantially heel-end-to-toe-end direction, in a diagonal direction with respect to the strikeface 604, or any combination thereof.

Figure 18:
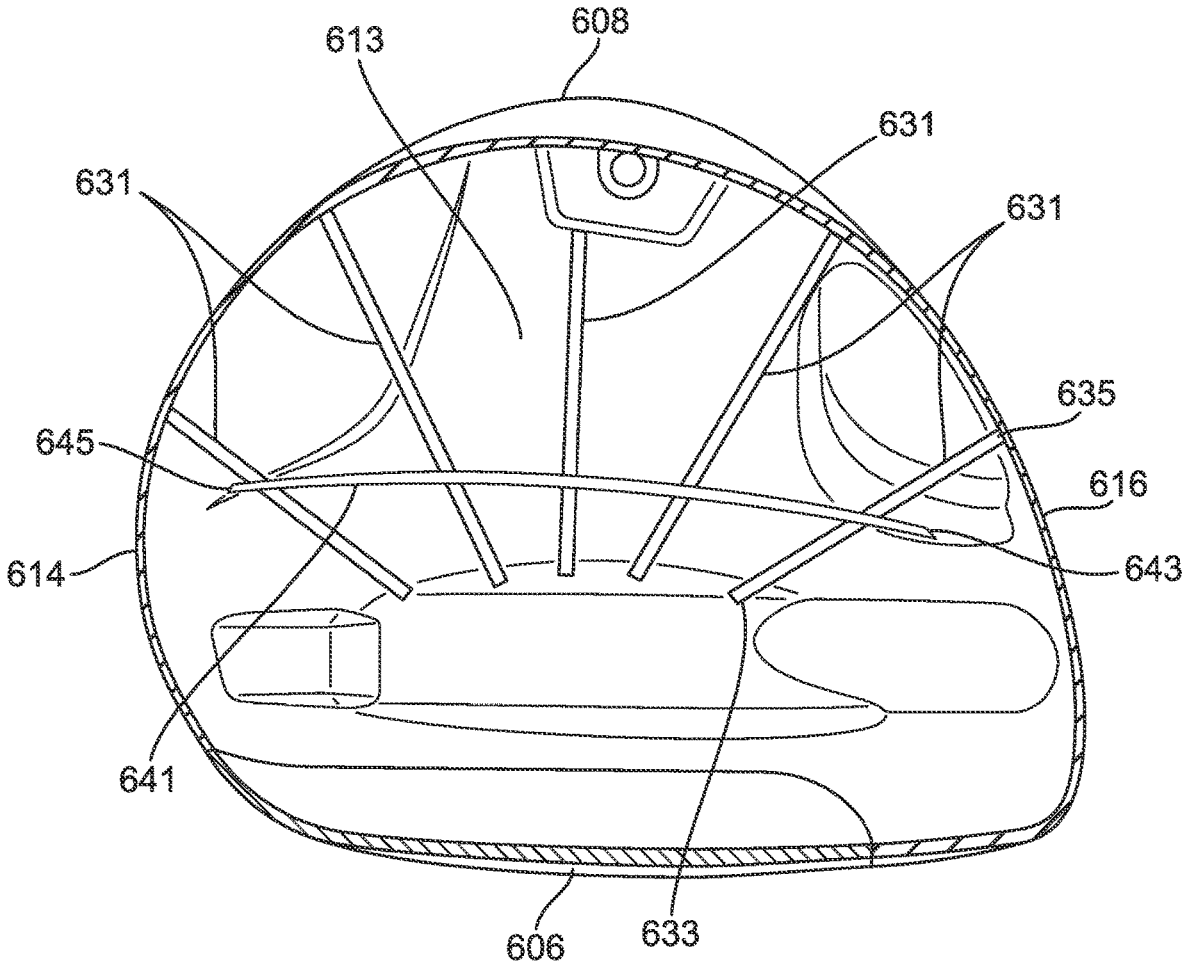
FIG. 18 is a top, cross-sectional view of the golf club head of FIG. 16, highlighting the orientation of a plurality of vibration damping ribs according to another embodiment.
Figure 19:
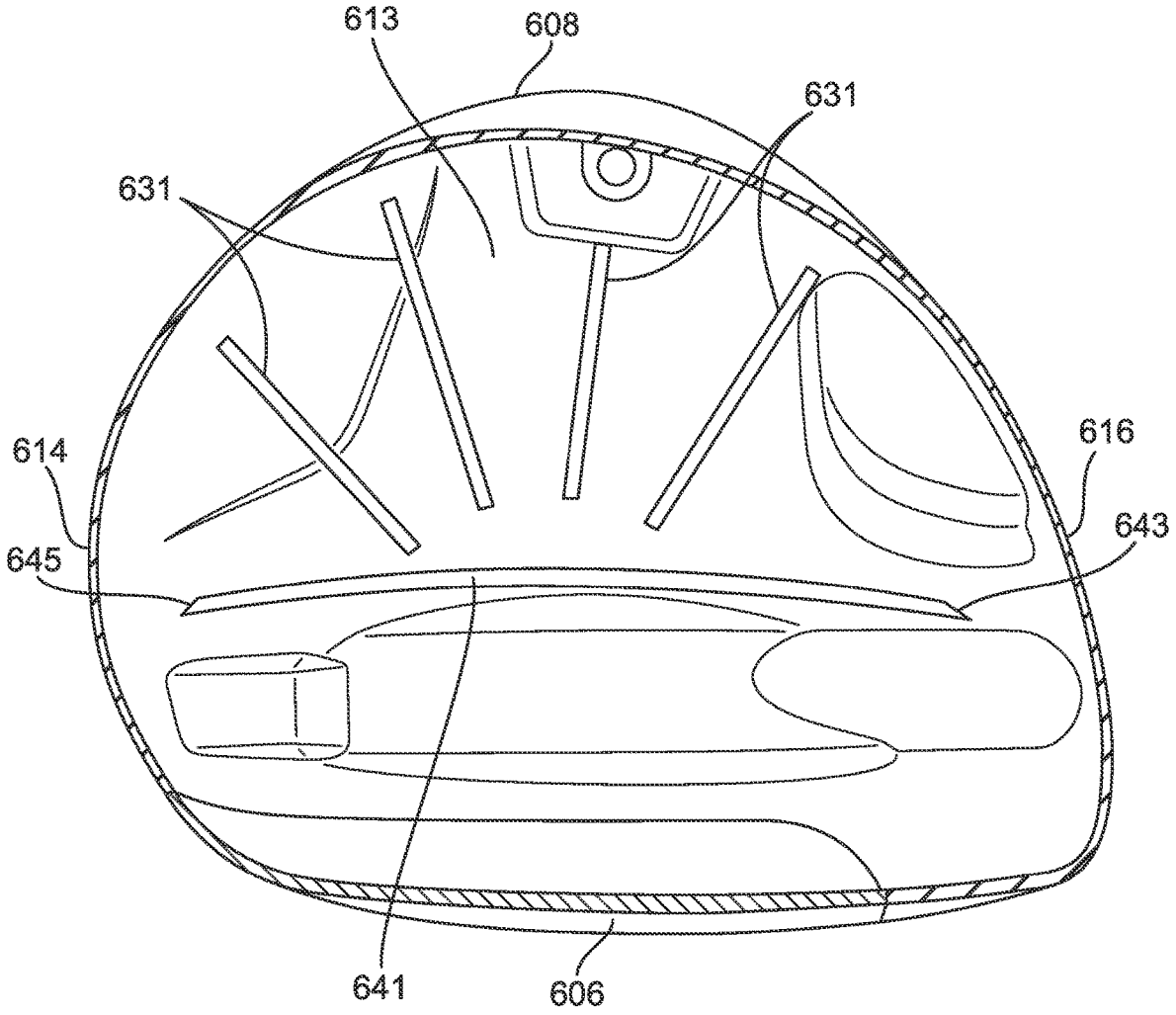
FIG. 19 is a top, cross-sectional view of the golf club head of FIG. 16, highlighting the orientation of a plurality of vibration damping ribs according to another embodiment.

In many embodiments, referring now to FIGS. 18 and 19, the plurality of vibration damping ribs 631 further comprises a central cross rib 641 extending along the internal surface 615 of the sole 612. In many embodiments, the central cross rib 641 comprises a length extending in a substantially heel-to-toe direction. In many embodiments, as illustrated in FIG. 18, the central cross rib 641 can intersect one or more of the radially arranged vibration damping ribs 631. In other embodiments, as illustrated in FIG. 19, the central cross rib 641 may be spaced away from and/or in front of the radially arranged vibration damping ribs 631, such that the central cross rib 641 does not intersect or contact any other vibration damping ribs 631. The central cross rib 641 can comprise a first end 643 located proximate the heel end 616 and a second end 645 located proximate the toe end 614.

In many embodiments, the central cross rib 641 can be provided at or near the peak curvature of the sole 612, (i.e the nadir 680). Typically, the club head 600 experiences dominant vibrations near the nadir 680, because the curvature of the sole 612 is tightest at or near the nadir 680. Providing a central cross rib 641 at or near the nadir 680 allows the dominant vibrations occurring at the nadir 680 to be damped without negatively affecting the flexure of the sole 612.

Figure 20:
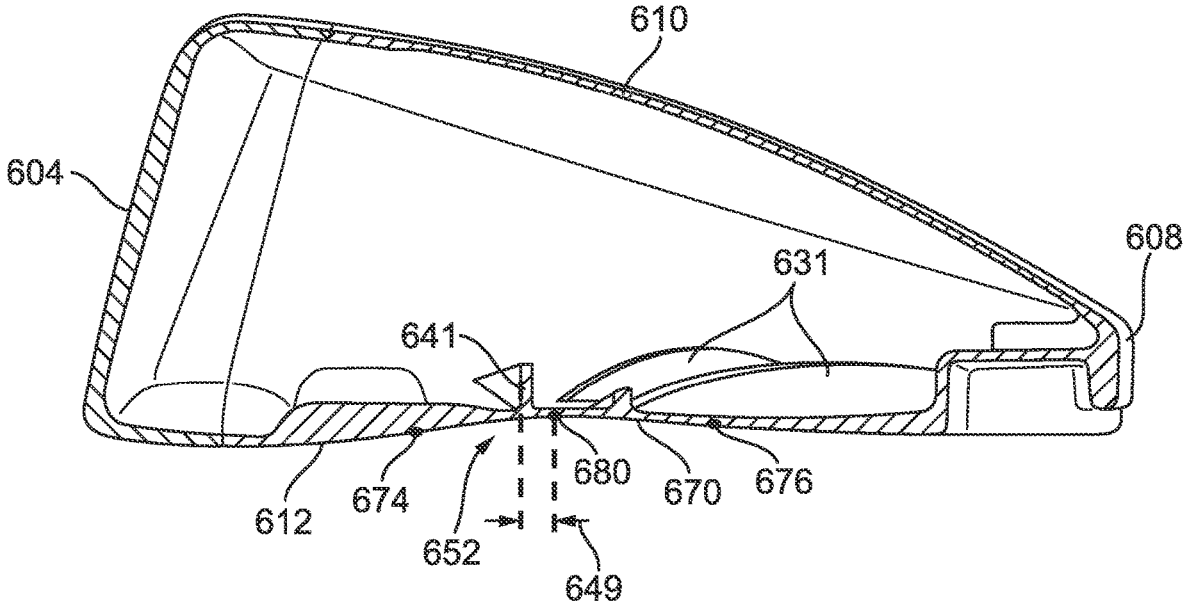
FIG. 20 is a cross-sectional view of the golf club head of FIG. 19, taken along the YZ plane.

Referring to FIG. 20, the central cross rib 641 can be located substantially near the nadir 680. The club head 600 can comprise an offset distance 649 between the central cross rib 641 and the nadir 680. In many embodiments, the offset distance 649 between the central cross rib 641 and the nadir 680 can be between 0 and 0.30 inches. In some embodiments, the offset distance 649 between the central cross rib 641 and the nadir 680 can be between 0 and 0.05 inches, between 0.05 and 0.10 inches, between 0.10 and 0.15 inches, between 0.15 and 0.20 inches, between 0.20 and 0.25 inches, or between 0.25 and 0.30 inches. In some embodiments, the offset distance 649 between the central cross rib 641 and the nadir 680 can be less than 0.30 inches, less than 0.25 inches, less than 0.20 inches, less than 0.15 inches, less than 0.10 inches, or less than 0.05 inches. In some embodiments, central cross rib 641 can be located directly on the nadir 680, such that the offset distance between the central cross rib 641 and the nadir 680 is zero.

IV. Reverse Camber Sole with Slot

Figure 21:
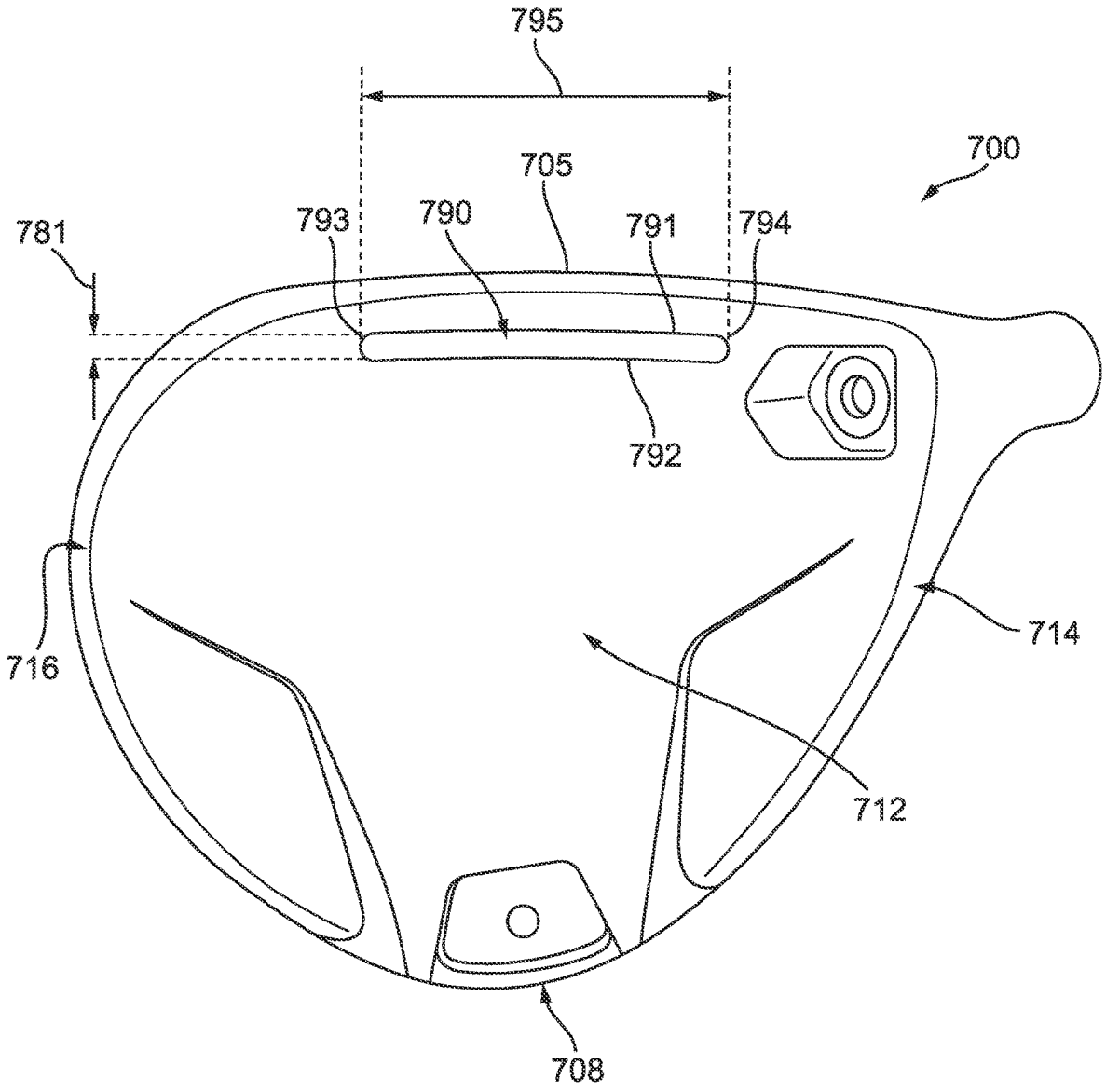
FIG. 21 is a sole view of a golf club head according to the present invention and comprising a sole slot.
Figure 22:
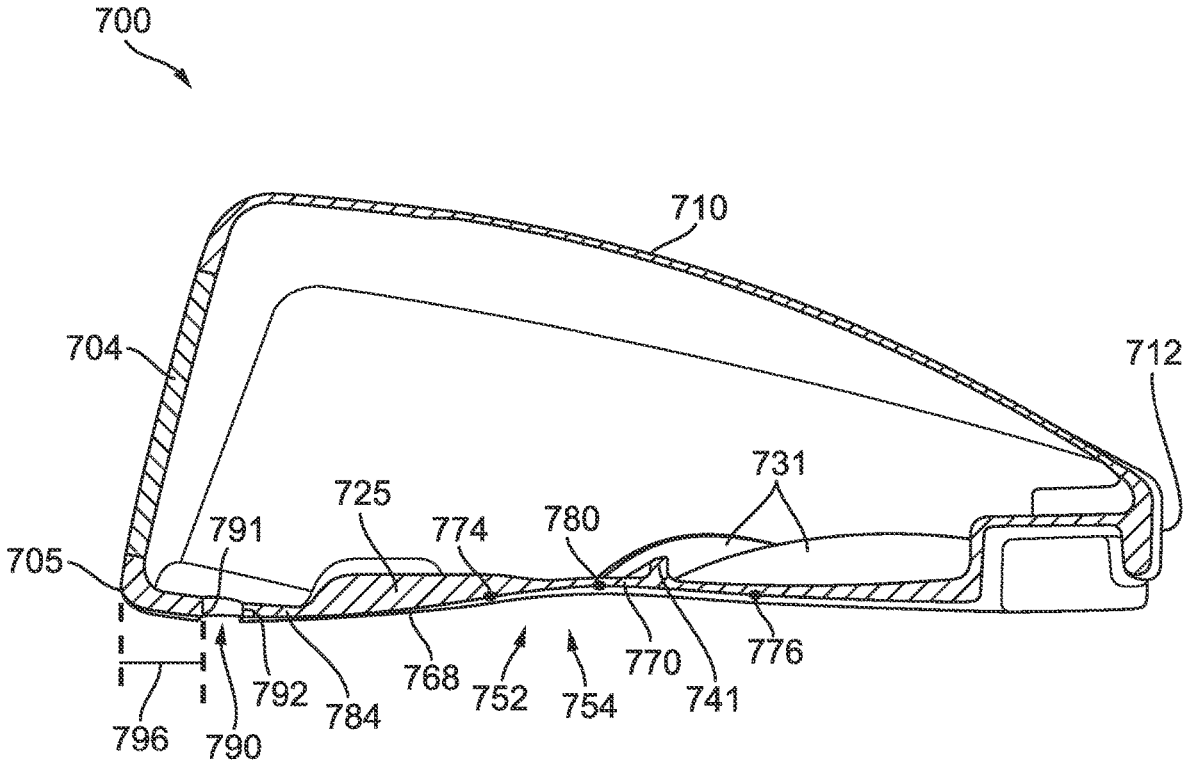
FIG. 22 is a cross-sectional view of the golf club head of FIG. 21, taken along the YZ plane.

FIGS. 21 and 22 illustrate a club head 700 comprising a reverse camber sole 712 in combination with a slot 790 according to another embodiment. The golf club head 700 is similar to the golf club heads of previous embodiments, but for the inclusion of the slot 790. Accordingly, the following description focuses primarily on the structure and features that are different from the embodiments described above. Features and elements that are described in connection with previous embodiments are numbered in the 700 series of reference numbers in FIGS. 21 and 22. It should be understood that the features of the golf club head 700 that are not explicitly described below have the same properties as the features of the golf club heads of previous embodiments. The sole slot 790 described herein can be combined with any of the crown 710 or sole 712 curvatures, the negative draft angle α, the return portion 721, the plurality of vibration damping ribs 731 described above, or any combination thereof.

In the present embodiment, the club head 700 comprises a reverse camber sole 712 comprising a first curvature section 784, a first concave section 768, a convex section 770, a nadir 780, and a second concave section 772. The club head 700 further comprises a slot 790. The slot 790 is located on the sole 712 of the club head 700 proximate the strikeface 704 and forward of the nadir 780. The slot 790 is provided as an aperture or through-opening in the sole 712 and can create a discontinuity in the sole 712. The slot 790 provides access into the interior of club head and/or provides a passageway from the exterior of the club head 700 into the internal cavity 718. The slot 790 works in conjunction with the indented region 752 such that the slot 790 increases the deflection of the sole 712 leading to an increase of stored internal energy and thus an increase in ball speed and ball travel distance.

Referring to FIG. 21, the slot 790 comprises a forward edge 791 and rear edge 792, a toe end 793, a heel end 794, and an insert (not shown) configured to cover or fill the slot 790. In the illustrated embodiment, the slot 790 takes a general elongated stadium shape (pill shape) with rounded ends. The heel end 794 and/or the toe end 793 can be rounded to reduce stress that builds up around the slot 790 edges during impact. In other embodiments, the slot 790 can take other various shapes and geometries to reduce stress buildup.

Referring to FIG. 21, the forward edge 791 can be offset from the leading edge 705 of the club head 700 by a distance 796 ranging from 3 mm and 15 mm, measured in a front-to-back direction and parallel to the ground plane 713. In some embodiments, the distance 796 between the forward edge 791 and the leading edge 705 can be between 3 mm and 5 mm, between 5 mm and 7 mm, between 7 mm and 9 mm, between 9 mm and 11 mm, between 11 mm and 13 mm, or between 13 mm and 15 mm.

The slot 790 comprises a depth 781 measured from the rear edge 792 to the forward edge 791. In many embodiments, the depth 781 of the slot 790 can range between approximately 4 mm and 7 mm. In some embodiments, the depth 781 of the slot 790 can be between 4 mm and 5 mm, between 5 mm and 6 mm, or between 6 mm and 7 mm.

The slot further comprises a length 795 measured in a heel-end-to-toe-end direction. In the illustrated embodiment, the length of the slot is approximately 60 mm. In other embodiments, the length 795 of the slot 790 can range between 30 mm and 80 mm. For example, the length 795 of the slot 790 can be between 30 mm and 35 mm, between 35 mm and 40 mm, between 40 mm and 45 mm, between 45 mm and 50 mm, between 50 mm and 55 mm, between 55 mm and 60 mm, between 60 mm and 65 mm, between 65 mm and 70 mm, between 70 mm and 75 mm, or between 75 mm and 80 mm. The length of the slot 790 can be 60 mm, 61 mm, 62 mm, 63 mm, 64 mm, 65 mm, 66 mm, 67 mm, 68 mm, 69 mm, 70 mm, 71 mm, 72 mm, 73 mm, 74 mm, 75 mm, 76 mm, 77 mm, 78 mm, 79 mm, or 80 mm.

The length 795, the depth 781, and the offset distance 796 can be adjusted to provide the slot with the optimal arrangement of geometries to be used in conjunction with the cambered sole. The combination of geometries will provide maximum increase in internal energy. The length 795, the depth 781, and the offset distance 796 can be further manipulated to provide the slot 790 with a balance of flexure and durability. The slot 790 can further comprise reinforcement structures such as ribs, mass pads, inserts, or other similar structures to reinforce the slot 790 and improve durability.

Referring to FIG. 22, in many embodiments, the slot 790 is located in a forward portion of the sole 712, near the leading edge 705. The forward positioning of the slot 790 maximizes the flexure of the sole 712 without interfering with the bending of the indented region 752. In many embodiments, the slot 790 can be located forward of the indented region 752. In many embodiments, the slot 790 can be located forward of the nadir 780. In some embodiments, the slot 790 can be located in front of the first inflection point 774. In other embodiments, the slot 790 can be located on or behind the first concave section transition point 788 and/or the first concave section 768.

In many embodiments, the golf club head 700 further comprises a mass pad 725 located on the internal surface 715 of the sole. Referring to FIG. 22, the mass pad 725 can be located rearward of the slot 790 and forward of the nadir 780. In many embodiments, the mass pad 725 can be spaced away from the rear edge 792 of the slot 790. In other embodiments (not shown), the mass pad 752 can be integral with the slot 790 such that at least a portion of the rear edge 792 can be formed by a portion of the mass pad 725. The mass pad 725 can influence the CG 746 position to be moved sole-ward and forward, which can lead to further increases in ball speed and/or reductions in ball spin rate.

As illustrated in FIG. 22, the golf club head 700 comprises a strikeface 704 located solely on the front end 706 of the club head (i.e. a "face pull" geometry). In such embodiments, the strikeface 704 is welded on to the front surface of the golf club head 700. In other embodiments, the strikeface 704 can comprise a face cup similar to the face cup described above in reference to club head 500. In embodiments in which the golf club head comprises a face cup, the slot 790 can be located on the return portion 721 of the sole 712 or rearward of the return portion 721.

As mentioned above, the slot 790 is implemented in conjunction with the cambered sole 712 to increase the overall deflection of the sole 712 and increase the energy transfer between the club head 700 and the golf ball. The cambered sole 712 can further help reduce stress near the toe end 794 and heel end 793 of the slot 790 by allowing the sole 712 to deflect further along the length 795 of the sole 712 to create a flow of stress rather than a buildup of stress. Combining the slot 790 with the cambered sole 712 can help distribute stress more evenly in a front-to-rear direction along the sole 712. The tight curvatures of the indented region 752 can help facilitate the flow of stress rearward and away from the slot 790.

Figure 23:
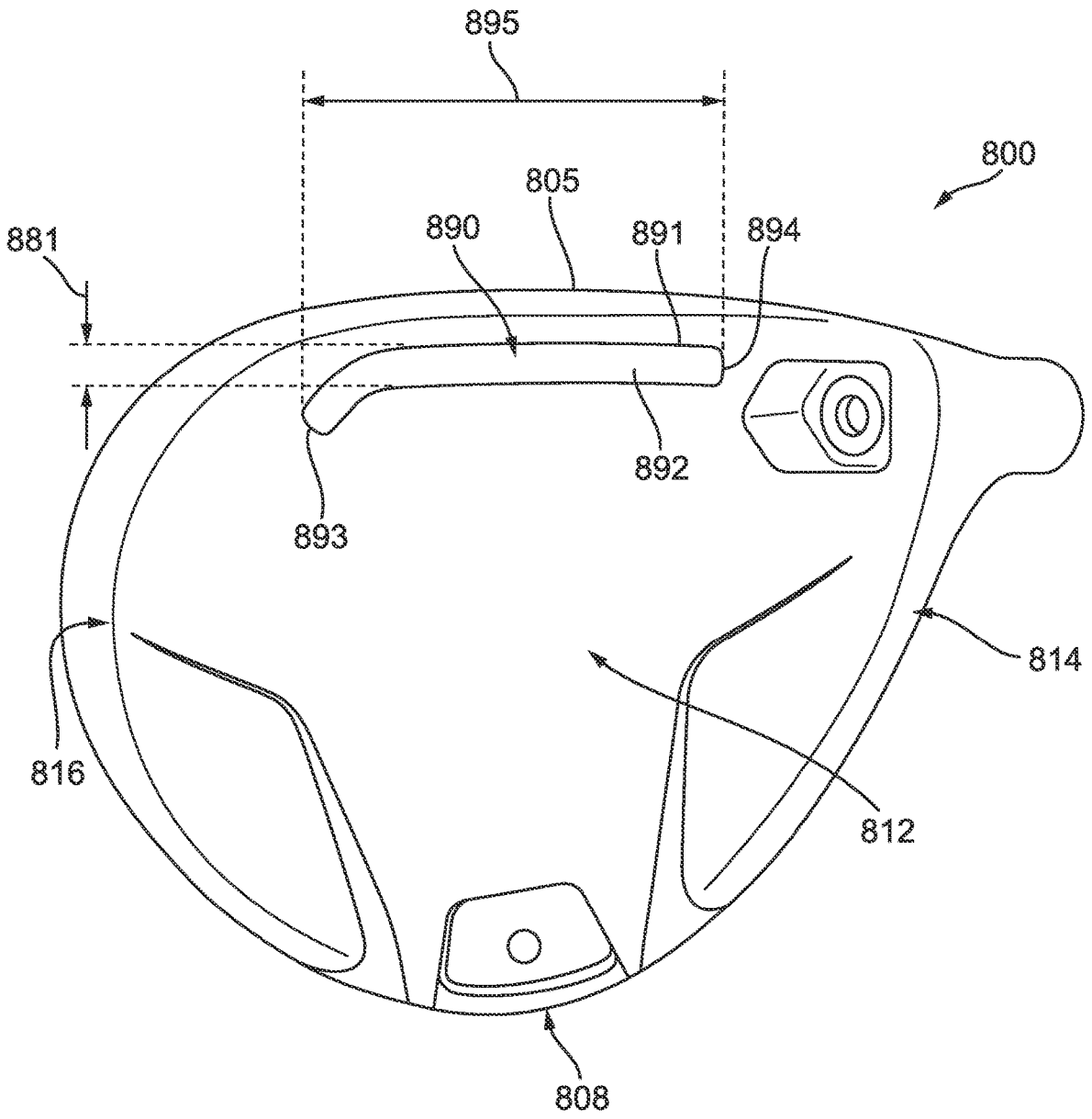
FIG. 23 is a sole view of a golf club head comprising a sole slot according to another embodiment.
Figure 24:
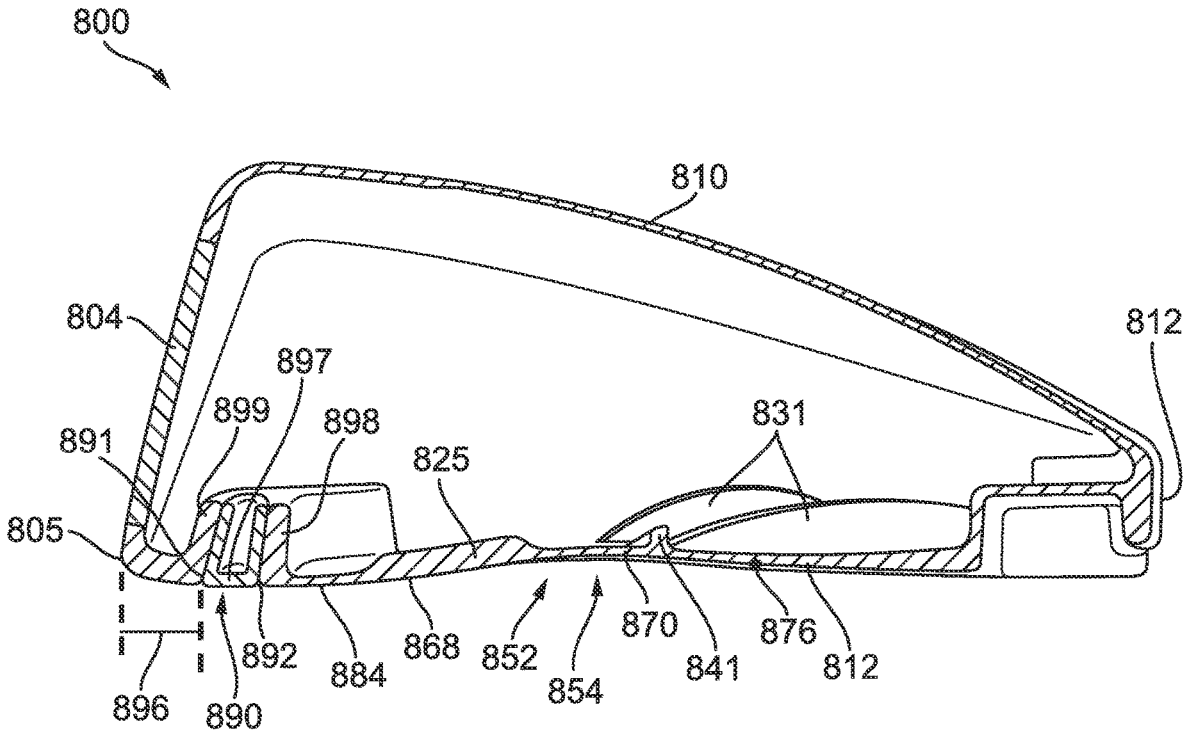

FIGS. 23 and 24 illustrate a club head 800 comprising a reverse camber sole 812 in combination with a slot 890 according to another embodiment. The golf club head 800 is similar to the golf club heads of previous embodiments, but for the inclusion of the slot 890. Accordingly, the following description focuses primarily on the structure and features that are different from the embodiments described above. Features and elements that are described in connection with previous embodiments are numbered in the 800 series of reference numbers in FIGS. 23 and 24. It should be understood that the features of the golf club head 800 that are not explicitly described below have the same properties as the features of the golf club heads of previous embodiments. The sole slot 890 described herein can be combined with any of the crown 810 or sole 812 curvatures, the negative draft angle α, the return portion 821, the plurality of vibration damping ribs 831 described above, or any combination thereof.

In the present embodiment, the club head 800 comprises a reverse camber sole 812 comprising a first curvature section 884, a first concave section 868, a convex section 870, a nadir 880, and a second concave section 872. The club head 800 further comprises a slot 890. The slot 890 is located on the sole 812 of the club head 800 proximate the strikeface 804 and forward of the nadir 880. The slot 890 is provided as an aperture or through-opening in the sole 812 and can create a discontinuity in the sole 812. The slot 890 provides access into the interior of club head and/or provides a passageway from the exterior of the club head 800 into the internal cavity 818. The slot 890 works in conjunction with the indented region 852 such that the slot 890 increases the deflection of the sole 812 leading to an increase of stored internal energy and thus an increase in ball speed and ball travel distance.

Referring to FIGS. 23 and 24, the slot 890 comprises a forward edge 891 and rear edge 892, a toe end 893, a heel end 894, and an insert 897 configured to cover or fill the slot 890. In many embodiments, the insert 897 may be made of an elastomeric material. The insert 897 plugs the slot to prevent debris from entering the interior cavity 818. The insert 897 can be configured to provide structural support around the edges of the slot 890 while also deforming at impact to maximize the energy transfer between the club head 800 and the golf ball without sacrificing durability of the club head 800.

Referring to FIG. 24, the slot 890 further comprises a forward wall 899 and a rear wall 898. The forward wall 899 extends inwardly into the interior cavity 818 from the forward edge 891 and is approximately perpendicular with the surface of the sole 812. Similarly, the rear wall 898 extends inwardly into the interior cavity 818 from the rear edge 892 and is approximately perpendicular with the surface of the sole 812. The rear wall 898 and the forward wall 899 can be approximately parallel. The forward wall 899 and rear wall 898 provide greater surface area for adherence of the insert 897. The surfaces of the insert 897 can be configured to adhere to the forward wall 899 and rear wall 898 of the slot 890. In many embodiments, the insert 897 can be coupled to the forward wall 899 and the rear wall 898 by adhesive means, mechanical means, or any other suitable means for coupling. In the illustrated embodiment, the slot 890 takes a similar shape to the slot 890 except that the slot 890 has a rounded/tapered toe end 893 to help reduce stress buildup. In other embodiments, the slot 890 can take other various shapes and geometries to reduce stress buildup.

Referring to FIG. 24, the forward edge 891 can be offset from the leading edge 805 of the club head 800 by a distance 896 ranging from 3 mm and 15 mm, measured in a front-to-back direction and parallel to the ground plane 713. In some embodiments, the distance 896 between the forward edge 891 and the leading edge 805 can be between 3 mm and 5 mm, between 5 mm and 7 mm, between 7 mm and 9 mm, between 9 mm and 11 mm, between 11 mm and 13 mm, or between 13 mm and 15 mm.

Referring to FIG. 23, the slot 890 comprises a depth 881 measured from the rear edge 892 to the forward edge 891. In many embodiments, the depth 881 of the slot 890 can range between approximately 4 mm and 7 mm. In some embodiments, the depth 881 of the slot 890 can be between 4 mm and 5 mm, between 5 mm and 6 mm, or between 6 mm and 7 mm.

The slot further comprises a length 895 measured in a heel-end-to-toe-end direction. In the illustrated embodiment, the length of the slot is approximately 68 mm. In other embodiments, the length 895 of the slot 890 can range between 30 mm and 80 mm. For example, the length 895 of the slot 890 can be between 30 mm and 35 mm, between 35 mm and 40 mm, between 40 mm and 45 mm, between 45 mm and 50 mm, between 50 mm and 55 mm, between 55 mm and 60 mm, between 60 mm and 65 mm, between 65 mm and 70 mm, between 70 mm and 75 mm, or between 75 mm and 80 mm. The length of the slot 890 can be 60 mm, 61 mm, 62 mm, 63 mm, 64 mm, 65 mm, 66 mm, 67 mm, 68 mm, 69 mm, 70 mm, 71 mm, 72 mm, 73 mm, 74 mm, 75 mm, 76 mm, 77 mm, 78 mm, 79 mm, or 80 mm.

The length 895, the depth 881, and the offset distance 896 can be adjusted to provide the slot with the optimal arrangement of geometries to be used in conjunction with the cambered sole. The combination of geometries will provide maximum increase in internal energy. The length 895, the depth 881, and the offset distance 896 can be further manipulated to provide the slot 890 with a balance of flexure and durability. The slot 890 can further comprise reinforcement structures such as ribs, mass pads, inserts, or other similar structures to reinforce the slot 890 and improve durability.

Referring to FIG. 24, in many embodiments, the slot 890 is located in a forward portion of the sole 812, near the leading edge 805. The forward positioning of the slot 890 maximizes the flexure of the sole 812 without interfering with the bending of the indented region 852. In many embodiments, the slot 890 can be located forward of the indented region 852. In many embodiments, the slot 890 is located forward of the nadir 880. In some embodiments, the slot 890 can be located in front of the first inflection point 874. In other embodiments, the slot 890 can be located on or behind the first concave section transition point 888 and/or the first concave section 868.

In many embodiments, the golf club head 800 further comprises a mass pad 825 located on the internal surface 815 of the sole. Referring to FIG. 24, the mass pad 825 can be located rearward of the slot 890 and forward of the nadir 880. In many embodiments, the mass pad 825 can be spaced away from the rear edge 892 of the slot 890. In other embodiments (not shown), the mass pad 852 can be integral with the slot 890 such that at least a portion of the rear edge 892 can be formed by a portion of the mass pad 825. The mass pad 825 can influence the CG 846 position to be moved sole-ward and forward, which can lead to further increases in ball speed and/or reductions in ball spin rate. The mass pad 825 can further provide structural support to the slot 890 by providing additional mass to reinforce the edges of the slot 890.

As illustrated in FIGS. 23 and 24, the golf club head 800 comprises a strikeface 804 located solely on the front end 806 of the club head (i.e. a "face pull" geometry). In such embodiments, the strikeface is welded on to the front surface of the golf club head 800. In other embodiments, the strikeface can comprise a face cup similar to the face cup described above in reference to club head 500. In embodiments in which the golf club head comprises a face cup, the slot 890 can be located on the return portion 821 of the sole 812 or rearward of the return portion 821.

As mentioned above, the slot 890 is implemented in conjunction with the cambered sole 812 to increase the overall deflection of the sole 812 and increase the energy transfer between the club head 800 and the golf ball. The cambered sole 812 can further help reduce stress near the toe end 894 and heel end 893 of the slot 890 by allowing the sole 812 to deflect further along the length 895 of the sole 812 to create a flow of stress rather than a buildup of stress. As discussed above, combining the slot 890 with the cambered sole 812 can help distribute stress more evenly in a front-to-rear direction along the sole 812. The tight curvatures of the indented region 852 can help facilitate the flow of stress rearward and away from the slot 890.

V. Examples

Example 1: Golf Club Head with Reverse Camber Sole

Figure 10:
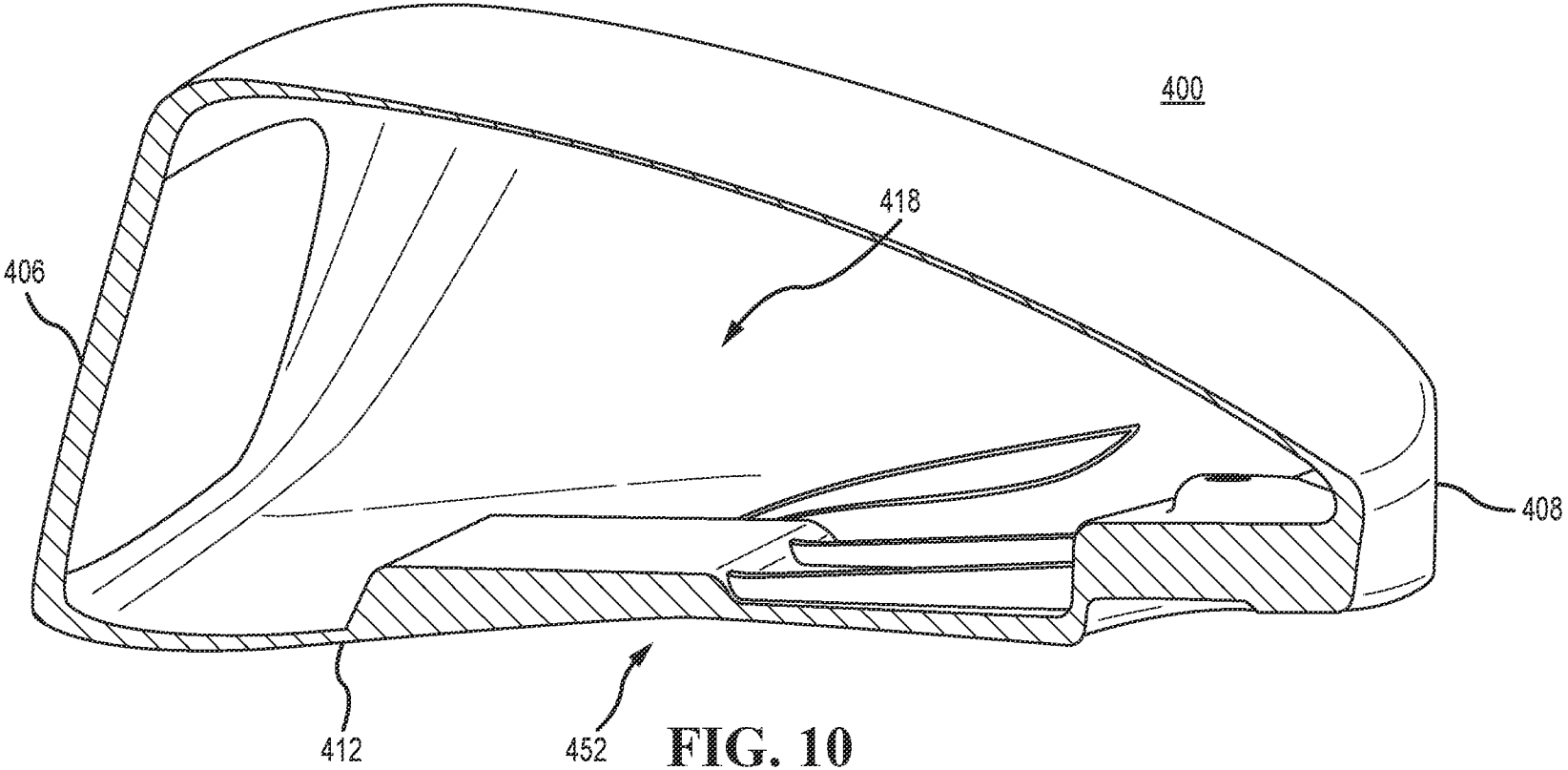
FIG. 10 is a perspective cross-sectional view of a golf club head.
Figure 12:
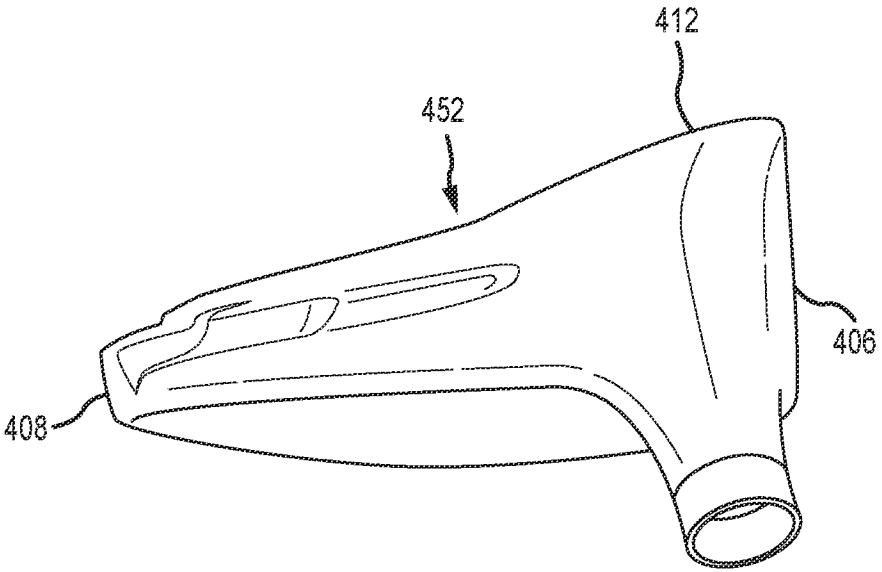
FIG. 12 is a heel-side perspective view of the golf club head of FIG. 10.
Figure 11:
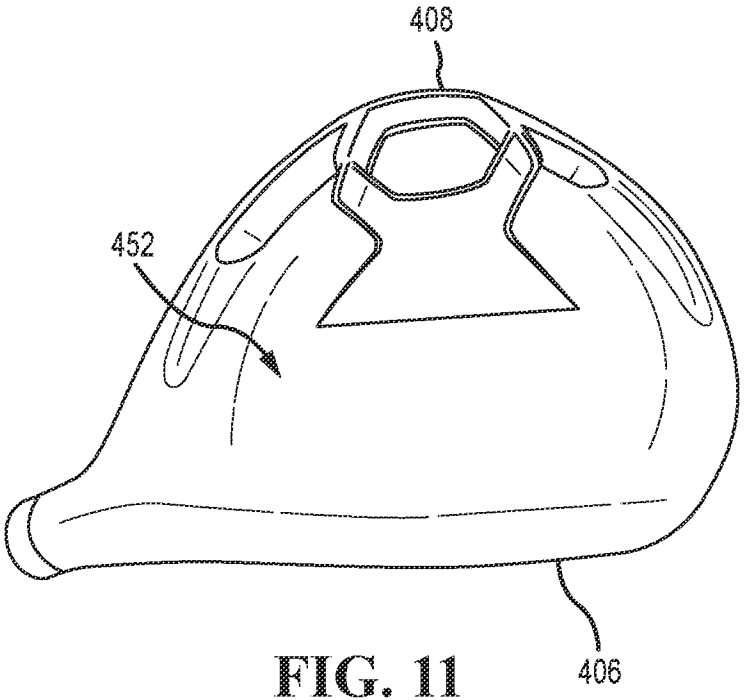
FIG. 11 is a bottom view of the golf club head of FIG. 10.

Referring to FIGS. 10-12, is a wood-type golf club head 400 having a sole 412 with an indent or indented region 452 where the sole 412 veers inward in a direction toward the internal cavity 418 of the club head 400. Accordingly, typical woods include sole profiles having relatively large radii of curvature between the front end and the back end (i.e., radii of curvature of around 22-25 inches). In contrast, the indented region 452 of the golf club head 400 allows the sole 412 to follow a much more tightly curved profile between the front end 406 and the back end 408. Moreover, in the illustrated embodiment of the club head 400, no portion of the sole 412 includes a radius of curvature greater than 6 inches when viewed from the side cross-sectional view taken along the YZ plane 1022.

The indented region 452 as described above allows the sole 412 of the club head 400 to follow a much more tightly curved profile between the front end 406 and the back end 408 as compared to metalwood club heads without this profile. This promotes greater deflection in the sole 412 of the club body 402 as the club head 400 impacts a golf ball. The greater deflection of the club body 402 generates a greater amount of internal energy within club head 400 as compared to traditional metalwood golf clubs without the indented region 452.

Figure 13:
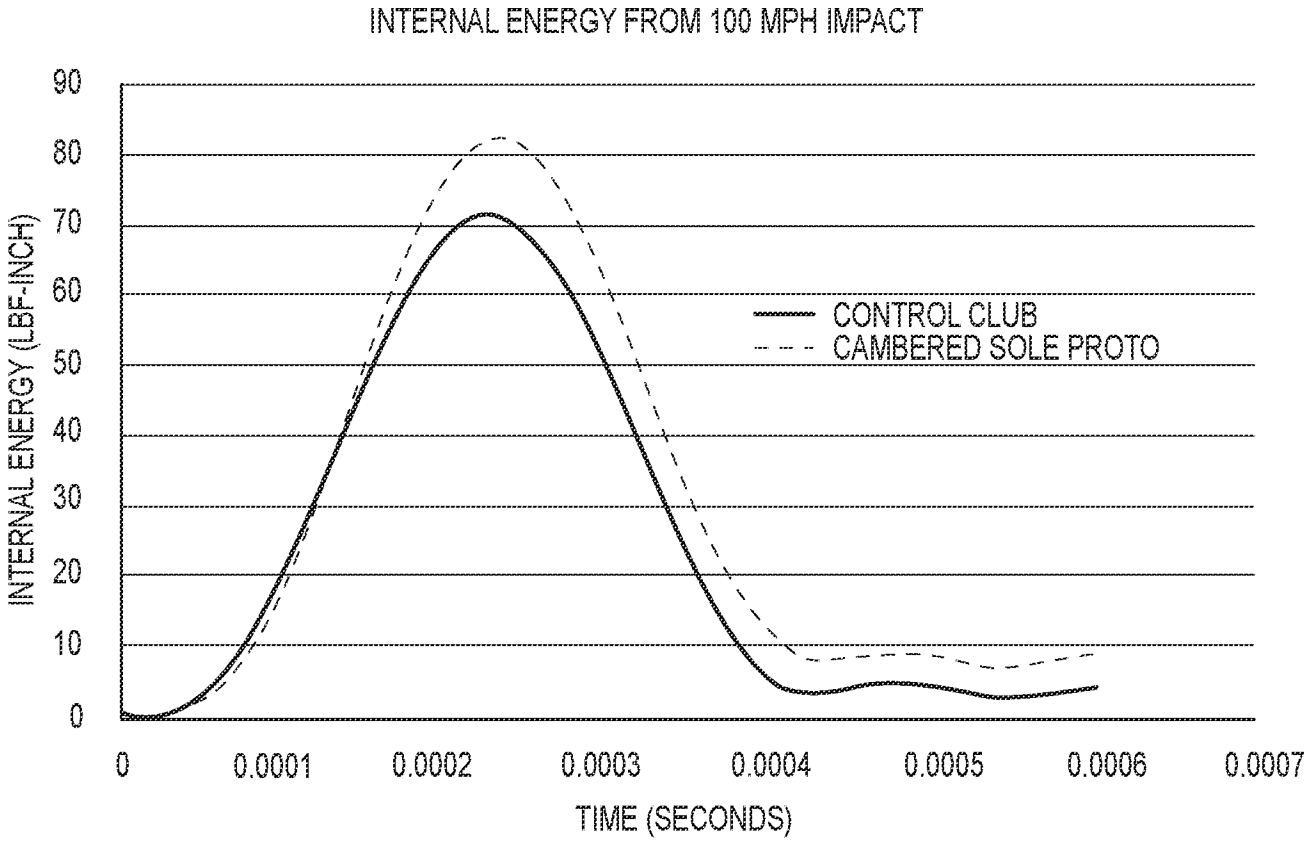
FIG. 13 is a graphical representation of the internal energy generated by the golf club of FIG. 10.

Referring to FIG. 13, the internal energy generated at impact by golf club head 400 was compared to the internal energy generated at impact by a golf club head (hereafter "control club") devoid of the indented region in the sole (a sole profile having relatively large radii of curvature between the front and back end of the club). The indented region 452 of golf club head 400, generates an increase in the internal energy of golf club head 400 by approximately 7.8 lbf-inch over the control club and thereby increases deflection. This 7.8 lbf-inch increase in internal energy translates to an approximately 1.0 mile per hour (mph) increase in ball speed (at a swing speed of 100 mph), thereby increasing a golf shot by at least 5 yards. Furthermore, the indented sole 412 of golf club head 400, retains more vibrational energy, immediately following impact, in the golf club head, allowing for higher energy transfer from the golf club head 400 to a golf ball, thereby increasing ball speed.

Further, the indented region 452 of golf club head 400, improves the ball speed of shots hit below the center of the strike face. The increased deflection of the indented sole 412 mitigates the high backspin caused by low face hits, leading to farther traveling golf shots than the control club. The indented region 452 in the sole 412 allows the front end 406 of the club head 400 to compress in a spring-like fashion down towards a ground plane and towards the back end 408 of the golf club head 400. This creates spring energy and delofts the golf club 400, thereby increasing the overall internal energy of the golf club 400 and decreasing the spin rate.

Additionally, the relatively greater deflection of the sole 412 during impact can lead to a reduction in ball spin rate experienced by the golf ball upon impact with the club head 400, over the control club. In one embodiment, the spin rate may be reduced by up to 150 revolutions per minute (RPM). In some embodiments, the ball spin rate may be reduced from around 600 RPM to around 450 RPM. The combination of increased ball speed and decreased spin rate, generated by the increased deflection of golf club head 400, leads to straighter and farther traveling golf shots, over the control club.

Example 2: Internal Energy of Golf Club Head with Reverse Camber Sole and Negative Draft Angle The internal energy generated at impact of an exemplary golf club head according to the present invention was compared to a control club head. The exemplary golf club head was similar to club head 500 and comprised an indented region in the sole, a face-crown transition radius of curvature of 0.23 inches, and a draft angle $\alpha$ of −5 degrees. The exemplary club head further comprised a face-crown transition radius of curvature R6 of 0.23 inches and a return section radius of curvature R7 of 5.80 inches. The control club head was devoid of the indented region in the sole and comprised a more conventional draft angle (1 degree). The internal energy generated at impact was simulated for each club using finite element analysis. The internal energy was measured for center strikes as well as strikes located 0.25 inch below center. Physical testing on production clubs will be conducted to show similar performance.

TABLE 1

| Club Head | Center Strike Internal Energy (lbf-in.) | Low-Center Strike Internal Energy (lbf-in.) |
|---|---|---|
| Control | 86.41 | 55.77 |
| Exemplary | 96.21 | 63.82 |

Figure 25:
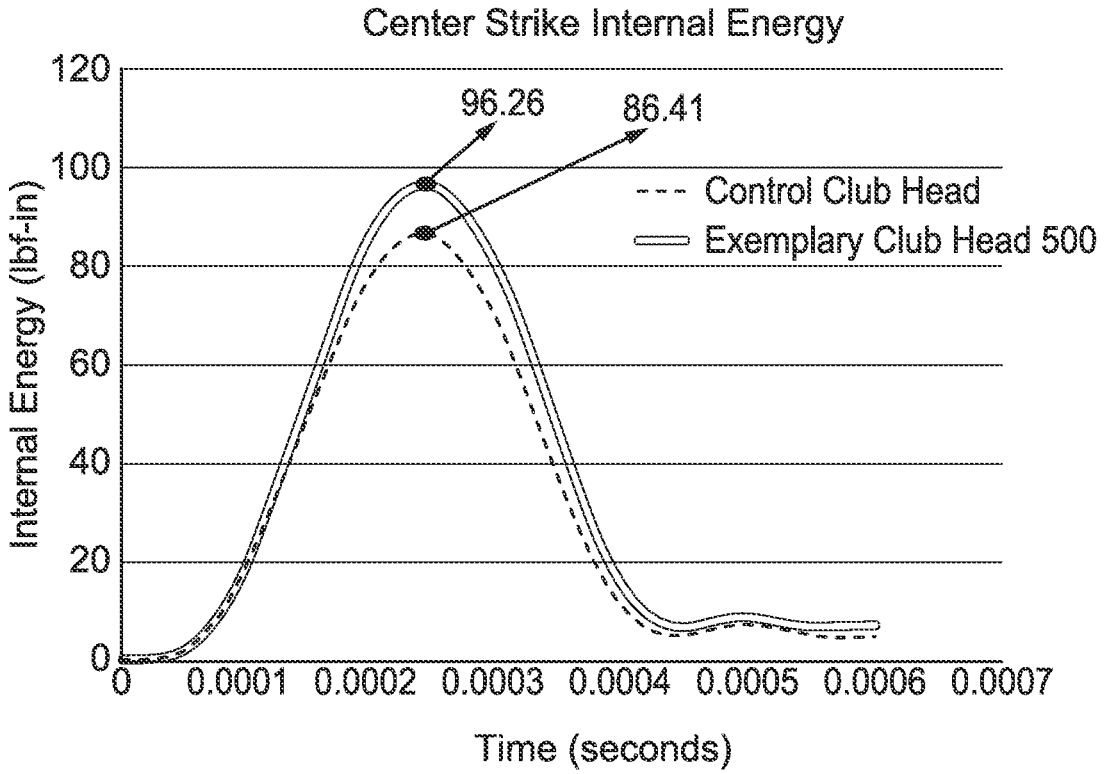
FIG. 25 is a graphical representation of the internal energy generated by the golf club head of FIG. 14 on center strikes.

Referring to FIG. 25 and Table 1, the combination of an indented region, a tight face-crown transition radius of curvature, and a negative draft angle $\alpha$ of the exemplary golf club head generated an increase in the internal energy of the exemplary club head by approximately 9.9 lbf-inch (an 11.4% increase) over the control club head. This 9.9 lbf-inch increase in internal energy translates to an approximately 1.0 mile per hour (mph) increase in ball speed, thus producing golf shots that travel an increased distance by at least 5 yards. The combination of an indented region, a tight face-crown transition radius of curvature, and a negative draft angle $\alpha$ produces increased deflection in the club head and greater energy transfer from the club head to a golf ball.

Figure 26:
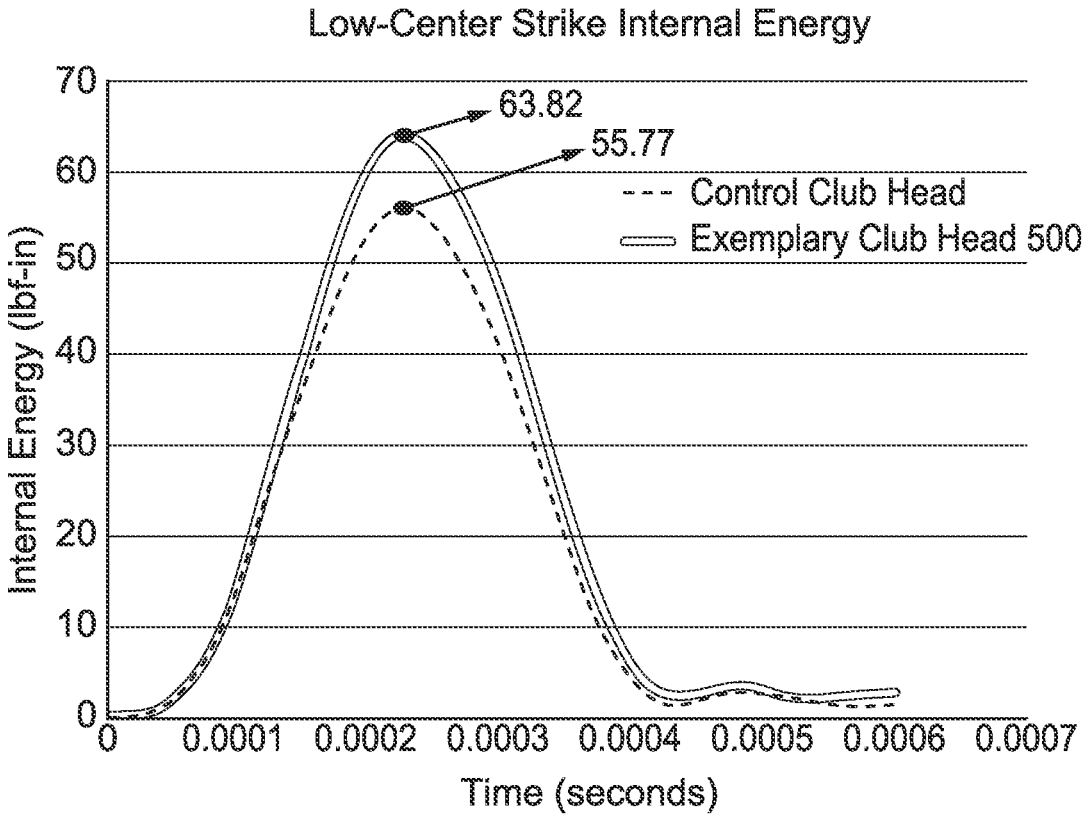
FIG. 26 is graphical representation of the internal energy generated by the golf club head of FIG. 14 on low-center strikes.
Figure 27A:
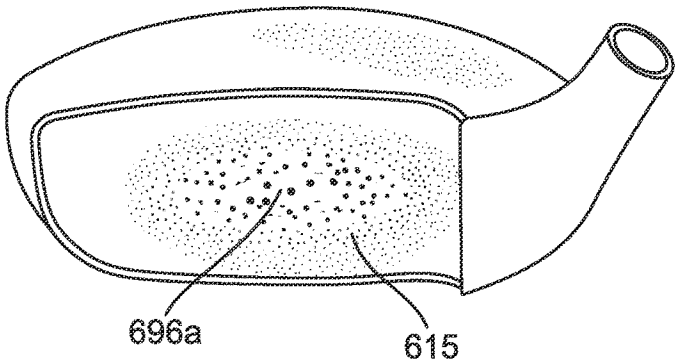
FIGS. 27A-27D illustrate various views of a control golf club head, highlighting the locations of dominant modes of vibration occurring in the club head at impact.
Figure 27B:
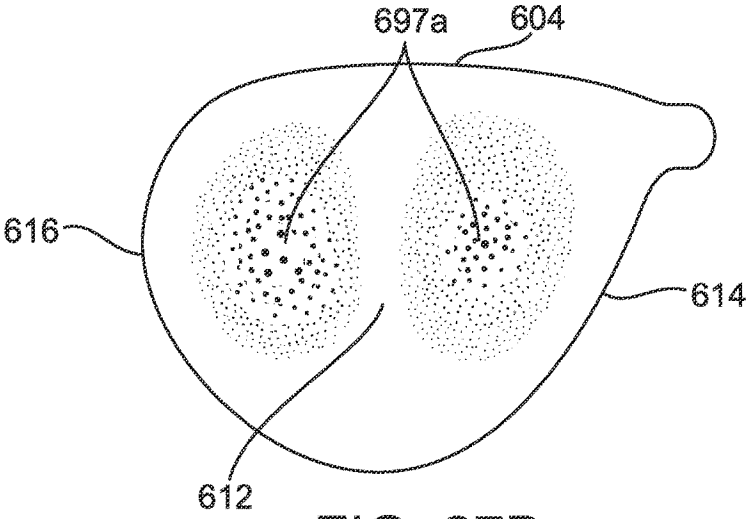
Figure 27C:
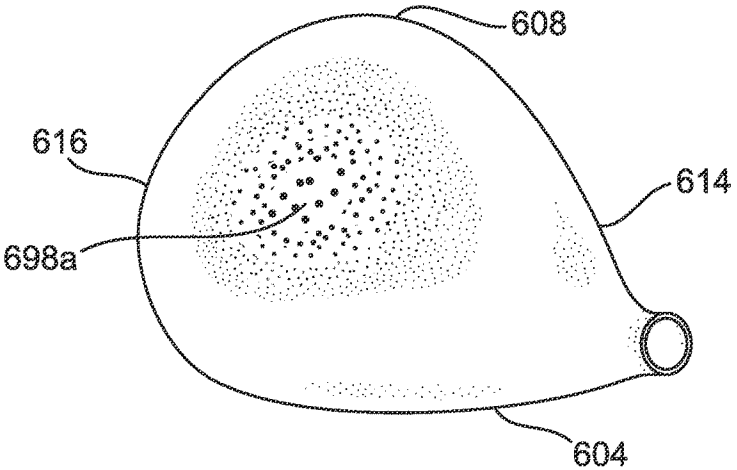
Figure 27D:
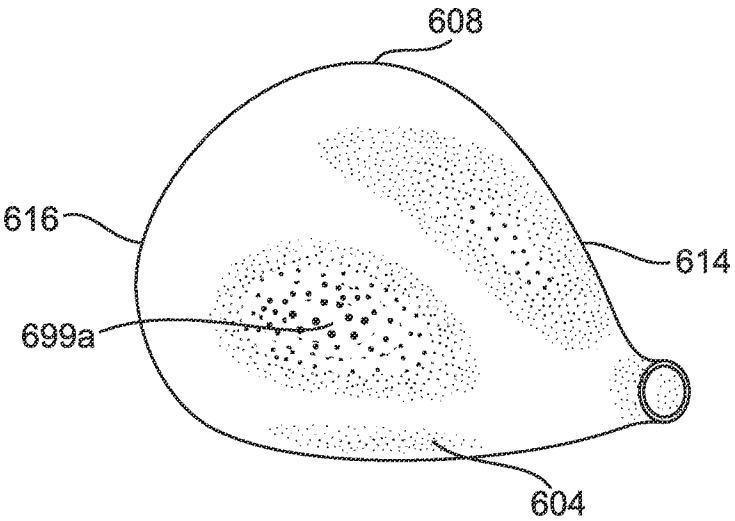
Figure 28A:
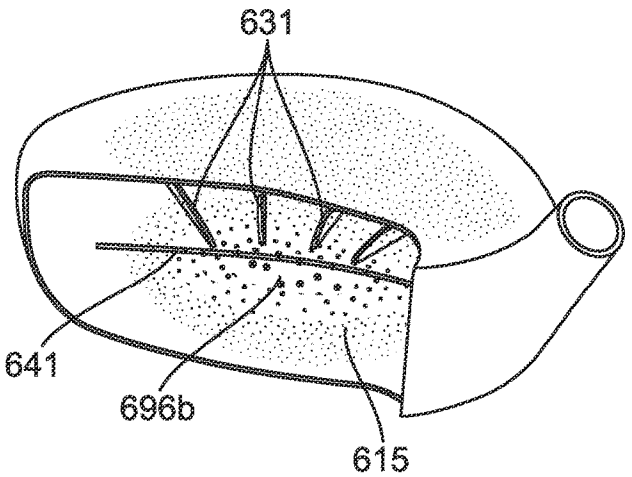
FIGS. 28A-28D illustrate various views of an exemplary golf club head comprising a plurality of vibration damping ribs, highlighting the locations of dominant modes of vibration occurring in the club head at impact.
Figure 28B:
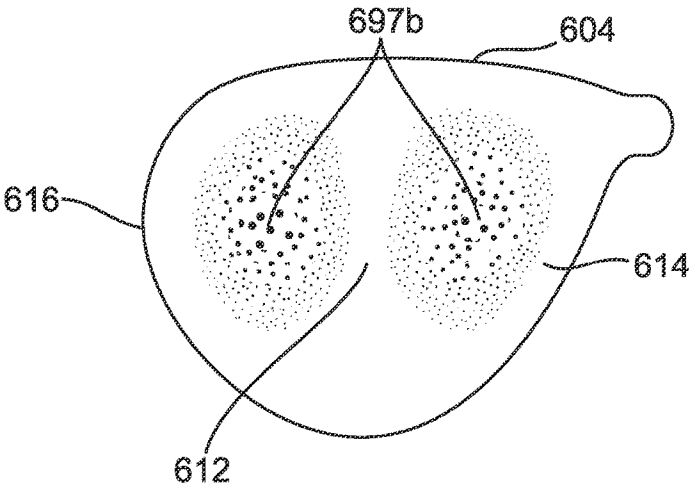
Figure 28C:
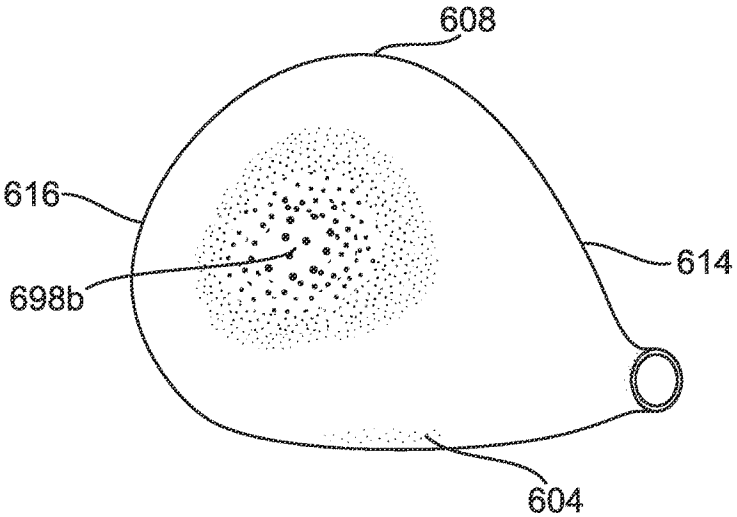
Figure 28D:
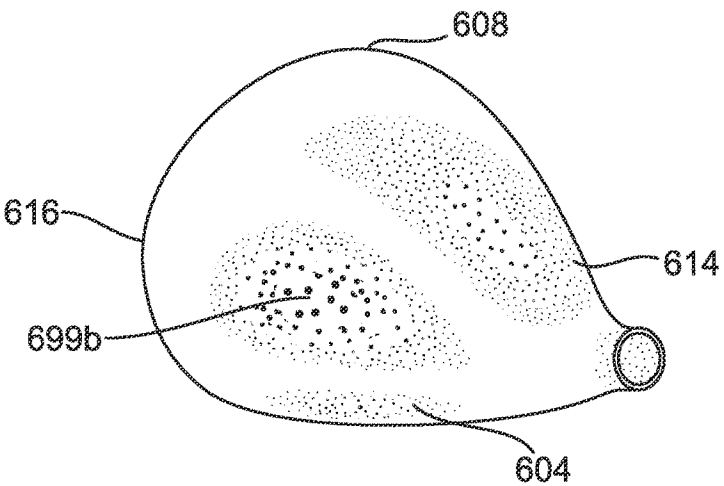

Referring now to FIG. 26 and Table 1, for shots hit 0.25 inch below the center of the face, the combination of the indented region, the tight face-crown transition radius of curvature, and negative draft angle $\alpha$ of the exemplary golf club head generated an increase in the internal energy of the exemplary golf club head by approximately 8.1 lbf-inch (a 14.4% increase) over the control club head. This 8.1 lbf-inch increase in internal energy translates to an approximately 0.97 mile per hour (mph) increase in ball speed, thus producing golf shots that travel an increased distance by at least 5 yards.

The exemplary club head exhibited internal energy and ball speed improvements for both center strikes and below-center strikes. However, the internal energy improvements were particularly significant for the below-center strikes. The increased deflection of the indented sole mitigates the typically high backspin caused by low face hits, leading to farther traveling golf shots than the control club. The reduction in backspin and increase in ball speed on low hits is especially advantageous, as low mis-hits are common when hitting a fairway wood-type golf club head.

Example 3: Performance of Golf Club Head with Reverse Camber Sole and Negative Draft Angle The performance characteristics (ball speed, launch angle, spin rate) of the exemplary club head of Example 2 was compared to the control club head of Example 2. The exemplary club head was similar to club head 500 and comprised an indented region in the sole, a face-crown transition radius of curvature of 0.23 inches, a draft angle $\alpha$ of −5 degrees, and a rear weight member housed within a weight recess located on a rearward portion of the sole. The control club head was similar to the exemplary club head, but devoid of the indented region in the sole and comprised a more conventional draft angle (1 degree). Ball speed, launch angle, and spin rate data was collected from a player performance test, in which a large sample of players hit a plurality of shots with each club head. The results of the player performance were averaged and are presented below in Table 2.

TABLE 2

| | Control Club Head | Exemplary Club Head | Difference |
|---|---|---|---|
| Ball Speed (mph) | 154.2 | 154.5 | +0.3 |
| Launch Angle (degrees) | 9.0 | 9.6 | +0.6 |
| Spin Rate (rpm) | 3706 | 3790 | +84 |

The exemplary club head exhibited an increase in ball speed of 0.3 mph (0.2% increase), an increase in launch angle of 0.6 degrees (6.7% increase), and an increase in spin rate of 84 rpm (2.3% increase) over the control club head. The ball speed and spin rate increases are considered negligible in terms of overall performance.

The exemplary club head exhibited an advantageous and significant increase in launch angle. The indented sole and negative draft angle caused the rear weight member housed within the rear weight recess to bend sole-ward about the nadir, causing the ball to launch higher, as discussed above. The increased launch angle provides multiple benefits. The increase in launch angle can produce golf shots that generally travel further, given the same ball speed. The increase in launch angle can also counteract the undesirable low launch caused by a low mis-hit, which is a common mis-hit with a fairway wood-type club head. The increase in launch angle further allows for the club head to be designed with less loft without sacrificing a desirable launch. Such delofting of the club head can provide a significant increase in ball speed.

Example 4: CG Position of Golf Club Head with Reverse Camber Sole and Negative Draft Angle The center of gravity position of an exemplary club head of Example 2 was compared to the control club head of Example 2. The exemplary club head was similar to club head 500 and comprised an indented region in the sole, a face-crown transition radius of curvature of 0.23 inches, and a draft angle $\alpha$ of −5 degrees. The control club head was devoid of the indented region in the sole and comprised a more conventional draft angle (1 degree). The CG heights and CG depths of each club head were measured according to the coordinate system defined below. The results are presented below in Table 3.

TABLE 3

| | CG Height (in.) | CG Depth (in.) |
|---|---|---|
| Control Club Head | 0.186 | 1.168 |
| Exemplary Club Head | 0.187 | 1.198 |
| Difference | 0.001 | 0.030 |

As evidenced by Table 2, the difference in CG height between the exemplary club head and the control club head was negligible. The CG depth of the exemplary club head increased by 0.030 inch over the control club head. The increase in CG depth exhibited by the exemplary club head, in general, equates to a more forgiving club head over the control club head.

In general, the CG height of the club head influences the launch angle. Generally, a lesser CG height corresponds to an increase in launch angle. Referring back to Example 3, the exemplary club head exhibited a significant increase in launch angle, despite the negligible difference in CG height. The increase in launch angle can therefore be attributed to the dynamic lowering of the CG at impact, caused by the negative draft angle and indented sole curvature of the exemplary club head.

Example 5: Golf Club Head with Reverse Camber Sole and Internal Curved Beams In one embodiment, an example golf club head 200 with reverse camber sole 212 (indented region 252) and one or more internal curved beams 290 was compared to a golf club head (hereafter "control club") with an extremely flexible reverse camber sole devoid of any internal curved beams. The one or more internal curved beams 290 function to partially stiffen and support flexible cambered sole 212.

As aforementioned the reverse camber sole 212 can increase the internal energy and resultant ball speed of a golf ball struck by the golf club head 200. However, for extremely fast golf swings, the reverse camber sole 212, may need reinforcement (one or more internal curved beams 292) to prevent permanent deformation of the sole 212 or fracture of the sole 212.

In comparison to the control club, the example golf club head 200, prevents some flexure in the sole 212, caused by the indented region 252. However, the golf club head 200, although not as flexible as the control club, still allows substantial flexure of the overall club head 200 and strike-face 204, thereby increasing the internal energy of the golf club head 200, while structurally reinforcing the sole 212.

In some embodiments, the example golf club head 200 with reverse camber sole 212 and one or more internal curved beams 290, can increase the internal energy generated at impact between 1.0-7.0 lbf-inch over the control club. In some embodiments, the internal energy generated at impact by golf club head 200 can be 1.0 lbf-inch, 2.0 lbf-inch, 3.0 lbf-inch, 4.0 lbf-inch, 5.0 lbf-inch, 6.0 lbf-inch, or 7.0 lbf-inch. This substantial increase in internal energy can lead to the ball speed increasing by 0.1 mph, 0.2 mph, 0.3 mph, 0.4 mph, 0.5 mph, 0.6 mph, 0.7 mph, 0.8 mph, 0.9 mph, or 1.0 mph, thereby increasing the travel distance of a golf ball by up to 5 yards.

Example 6: Golf Club Head with Reverse Camber Sole and Slot

The internal energy generated at impact of an exemplary golf club head according to the present invention was compared to a control club head. The exemplary golf club head was similar to golf club head 800 and comprised a slot 890 located on the sole 812 forward of the nadir 880 and rearward of the leading edge 805. As discussed above, the slot 890 acts in combination with the indented region 852 to allow for greater deflection of the sole 812 of the club head body. The slot 890 of the exemplary club head comprised a forward wall 899, a rear wall 898, and an insert 897. The insert 897 filled the slot 890 and adhered to the forward wall 899 and rear wall 898. The insert 897 is made of an elastomeric material so that the insert 897 does not restrict deflection of the slot 890.

The indented region 852 as described above allows the sole 812 of the club head 800 to follow a much more tightly curved profile between the front end 806 and the back end 808 as compared to club heads without this profile. This promotes greater deflection in the sole 812 of the club body 802 as the club head 800 impacts a golf ball. The greater deflection of the club body 802 generates a greater amount of internal energy within club head 800 as compared to traditional golf clubs without the indented region 852.

The exemplary club head 800 further comprised a face-crown transition radius of curvature of 0.23 inches and a draft angle α of −5 degrees. The exemplary club head 800 further comprises a variable face thickness such that the perimeter of the face was approximately 0.060 inches thick. The control club head comprised no slot, was devoid of the indented region in the sole, and comprised a more conventional draft angle (1 degree). The control club head further comprised a perimeter face thickness of approximately 0.068 inches. The internal energy generated at impact was simulated for each club using finite element analysis. The internal energy was measured for center strikes.

TABLE 4

| Club Head | Center Strike Internal Energy (lbf-in.) |
|---|---|
| Control | 64.0 |
| Exemplary | 72.3 |

The exemplary club head 800 exhibited a stored internal energy of 72.3 lbf-inch. The control club head exhibited a stored internal energy of 64.0 lbf-inch. The exemplary club head 800 generated an increase in the internal energy over the control club head by approximately 8.3 lbf-inch (13.0% increase), thereby increasing deflection. This 8.3 lbf-inch increase in internal energy translates to an approximately 1.0 mile per hour (mph) increase in ball speed, which represents the additional spring energy of the club (at a swing speed of 100 mph). The combination of the sole slot, the indented region, a tight face-crown transition radius of curvature, and a negative draft angle α produces increased deflection in the club head and greater energy transfer from the club head to a golf ball. The greater energy transfer exhibited by the exemplary club head may also be accounted for by other variables such as the reduced thickness in the exemplary face perimeter in comparison to the control face perimeter, the respective crown thickness of each club head, and/or other variables.

The present example represents a desirable configuration for increasing flexure of the sole and the internal energy of the club head, but does not account for club head durability. Further design changes may be made in the future to improve the durability of the club head, but such improvements are predicted to retain significant ball speed and internal energy gains over the control club head.

Example 7: Golf Club Head with Reverse Camber Sole and Vibration Damping Ribs

The vibrational response at impact of an exemplary golf club according to the present invention was compared to the vibrational response of a control golf club head. The exemplary club head was similar to club head 600 and comprised an indented region in the sole, a face-crown transition radius of curvature of 0.23 inches, a draft angle α of −5 degrees, and a plurality of vibration damping ribs. The plurality of vibration damping ribs included a plurality of radial ribs and cross rib located directly on the nadir of the sole curvature. The control club head was similar to club head 500 and comprised a similar indented region in the sole, a similar draft angle, but was devoid of any vibration damping ribs. Modal analysis was performed on each club head to determine the location of dominant modes of vibration and the frequency of said dominant modes. Physical testing on production clubs will be conducted to show similar performance.

As illustrated by FIGS. 27A-27D, the control club head displayed four dominant modes of vibration 696*a*, 697*a*, 698*a*, 699*a*. The control club head comprised a first dominant mode 696*a* located on the sole and coinciding with the location of the nadir, a second dominant mode 697*a* located on the sole and proximate the toe end, a third dominant mode 698*a* centrally located on the crown, and a fourth dominant mode 699*a* located on the crown and proximate the toe end. As illustrated by FIGS. 28A-28D, the exemplary club head displayed dominant modes of vibration 696*b*, 697*b*, 698*b*, 699*b* corresponding to the dominant modes of vibration 696*a*, 697*a*, 698*a*, 699*a* of the control club head. The exemplary club head dominant modes 696*b*, 697*b*, 698*b*, 699*b* were located in similar locations as the control club head dominant modes 696*a*, 697*a*, 698*a*, 699*a*. The frequency of each dominant mode was compared between the exemplary club head and the control club head, and the results are presented below in Table 5.

TABLE 5

| | Center Sole Frequency (Mode 1) | Toe-Side Sole Frequency (Mode 2) | Center Crown Frequency (Mode 3) | Toe-Side Crown Frequency (Mode 4) |
|---|---|---|---|---|
| Control Club Head | 2238 Hz | 3259 Hz | 4211 Hz | 4453 Hz |
| Exemplary Club Head | 2428 Hz | 3629 Hz | 4354 Hz | 4532 Hz |
| Difference | 8.5% | 2.8% | 3.4% | 1.8% |

As evidenced by Table 5, the exemplary club head exhibited an increase in frequency at each of the dominant modes of vibration. The increase in the dominant reverberation frequency provides the exemplary golf club head 600 with a more desirable acoustic response at impact as well as a desirable "soft" feel at impact.

As displayed in Table 4, the greatest increase in frequency was observed in the first mode 696*b* located at the peak curvature of the sole (i.e. at the nadir), wherein the exemplary golf club head saw an 8.5% increase over the frequency of the control club. Such a large frequency increase at the peak sole curvature shows the direct effect of the ribs in damping unwanted vibrations, because the cross rib was located directly at the nadir. Although the indented portion and tight curvatures of various portions of the sole may introduce acoustically displeasing vibrations, the vibration damping ribs can be included to counteract said vibrations. The combination the indented sole and vibration damping ribs results in a high performing golf club head that feels "soft" at impact and is acoustically pleasing. Qualitative player data regarding feel and sound will follow.

Various features and advantages of the disclosures are set forth in the following claims.

Replacement of one or more claimed elements constitutes reconstruction and not repair. Additionally, benefits, other advantages, and solutions to problems have been described regarding specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a wood-type golf club, the apparatus, methods, and articles of manufacture described herein may be applicable to a variety of types of golf clubs including drivers, fairway woods, hybrids, crossovers, or any hollow body type golf clubs.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Although the invention has been described in detail with reference to certain preferred embodiments, variations and modifications exist within the scope and spirit of one or more independent aspects of the invention as described.

CLAUSES

Clause 1: A golf club head comprising: a body having a front end, a back end opposite the front end, a crown, a sole opposite the crown, the sole defining a sole surface; wherein the front end, the back end, the crown, and the sole form a hollow interior cavity; wherein a ground plane is tangent to the sole surface when the golf club head is at an address position to strike a golf ball; a heel, a toe opposite the heel, and a hosel structure having a hosel axis extending centrally through a bore in the hosel structure, a strike face positioned at the front end and defining a geometric center, and a loft plane tangent to the geometric center, wherein the geometric center further defines a coordinate system having the geometric center, the coordinate system comprising an x-axis extending through the geometric center between the heel and the toe, a y-axis extending through the geometric center and perpendicular to the x-axis, between the crown and the sole, a z-axis extending through the geometric center and perpendicular to the x-axis and to the y-axis, between the front end and the back end, the y-axis and the z-axis together define a YZ plane extending between the crown and the sole and between the front end and the back end; the x-axis and the y-axis together define a XZ plane extending between the heel and the toe and between the front end and the back end; an indented region; wherein the indented region is defined where the sole veers inward in a direction toward the hollow interior cavity; a sole transition point defined by an intersection of the sole and the strike face; the indented region comprises a sole curvature profile defined by an intersection of the sole surface and the YZ plane; wherein the sole curvature profile comprises a first inflection point and a second inflection point; wherein the sole curvature profile comprises a first concave section extending from the sole transition point to the first inflection point and is concave relative to the XZ plane; a convex section extending from the first inflection point to the second inflection point and is concave relative to the XZ plane; a second concave section extending from the second inflection point to the back end and is concave relative to the XZ plane; wherein the first concave section comprises a radius of curvature (R3), the convex section comprises a radius of curvature (R4), the second concave section comprises a radius of curvature (R5); wherein the sole curvature profile further comprises a nadir; wherein the nadir represents a point of the sole curvature profile that is closet to the XZ plane; wherein the nadir is located on the convex section; wherein the strike face forms a crown return such that the crown return extends rearward from the front end and forms a portion of the crown; the crown return comprises a face-crown transition profile having a face-crown transition radius (R6); the crown return comprises a crown transition point defined where the face-crown transition profile departs of the face-crown transition radius (R6); the crown return comprises a return section radius of curvature (R7); the crown comprising a crown radius of curvature (R8); a return transition point defined where the return section radius of curvature (R7) transitions to the crown radius curvature (R8); a crown return plane extending in a heel-to-toe direction and intersecting the crown transition point and the return transition point; a reference plane parallel to the ground plane and intersecting the crown transition point; and a draft angle measured between the crown return plane and the reference plane.

Clause 2: The golf club head of clause 1, wherein the face-crown transition radius (R6) is less than 0.50 inches.

Clause 3: The golf club head of clause 1, wherein the draft angle is between 0 degrees and −10 degrees.

Clause 4: The golf club head of clause 1, wherein an increase in an internal energy generated at impact of the golf club head over a control club head devoid of a sole curvature comprising an indented region is greater than 7.0 lbf-inch.

Clause 5: The golf club head of clause 1, wherein the return section radius of curvature (R7) is at least than 5.0 inches.

Clause 6: The golf club head of clause 1, defining a return transition point depth ratio defined as a depth of the return transition point to an overall depth of the golf club head; wherein the return transition point depth ratio is greater than 0.10.

Clause 7: The golf club head of clause 1, wherein the golf club head comprises a crown radius of curvature (R8) of at least 5 inches.

Clause 8: The golf club head of clause 1, the golf club head comprising a crown-sole radii curvature ratio defined as the crown radius of curvature (R8) over the convex section radius of curvature (R4); wherein the crown-sole radii curvature is greater than 1.5.

Clause 9: The golf club head of clause 1, further comprising a plurality of ribs located on an internal surface of the sole.

Clause 10: The golf club head of clause 9, wherein one or more of the plurality of ribs form a radial pattern.

Clause 11: The golf club head of clause 9, wherein one of the plurality of ribs comprises a cross rib extending in a heel-to-toe direction across the internal surface of the sole.

Clause 12: The golf club head of clause 11, wherein the cross rib intersects one or more of the plurality of ribs.

Clause 13: The golf club head of clause 11, wherein the cross rib is located within 0.30 inches of the nadir.

Clause 14: The golf club head of clause 11, wherein the cross rib is located at the nadir.

Clause 15: The golf club head of clause 9, wherein a height of at least one rib of the plurality of ribs varies along a length of the at least one rib.

Clause 16: The golf club head of clause 1, further comprising a slot located on sole; wherein the slot is defined as an aperture through the sole such that the slot provides access to the internal cavity of the golf club head; and wherein the slot extends in a heel to toe direction.

Clause 17: The golf club head of clause 16, wherein the slot is located forward of the first inflection point and rearward of a leading edge of the golf club head.

Clause 18: The golf club head of clause 16, wherein the slot comprises a length measured in a direction from heel to toe; wherein the length is between 30 mm and 70 mm.

Clause 19: The golf club head of clause 18, wherein the slot comprises a forward edge and a rear edge located rearward of the forward edge; wherein the forward edge is spaced a distance between 3 mm to 15 mm away from a leading edge of the golf club head.

Clause 20: The golf club head of clause 19, wherein the slot comprises a depth measured from the forward edge of the slot to the rear edge of the slot; wherein the depth is between 4 mm and 7 mm.

The invention claimed is:

1. A golf club head comprising:

a body having a front end, a back end opposite the front end, a crown, a sole opposite the crown, the sole defining a sole surface;

wherein the front end, the back end, the crown, and the sole form a hollow interior cavity;

wherein a ground plane is tangent to the sole surface when the golf club head is at an address position to strike a golf ball;

a heel, a toe opposite the heel, and a hosel structure having a hosel axis extending centrally through a bore in the hosel structure, a strike face positioned at the front end and defining a geometric center, and a loft plane tangent to the geometric center, wherein the geometric center further defines a coordinate system having the geometric center, the coordinate system comprising an x-axis extending through the geometric center between the heel and the toe, a y-axis extending through the geometric center and perpendicular to the x-axis, between the crown and the sole, a z-axis extending through the geometric center and perpendicular to the x-axis and to the y-axis, between the front end and the back end, the y-axis and the z-axis together define a YZ plane extending between the crown and the sole and between the front end and the back end;

the x-axis and the z-axis together define a XZ plane extending between the heel and the toe and between the front end and the back end;

an indented region;

wherein the indented region is defined where the sole veers inward in a direction toward the hollow interior cavity;

a sole transition point defined by an intersection of the sole and the strike face; the indented region comprises a sole curvature profile defined by an intersection of the sole surface and the YZ plane;

wherein the sole curvature profile comprises a first inflection point and a second inflection point;

wherein the sole curvature profile comprises a first concave section extending from the sole transition point to the first inflection point and is concave relative to the XZ plane;

a convex section extending from the first inflection point to the second inflection point and is concave relative to the XZ plane;

a second concave section extending from the second inflection point to the back end and is concave relative to the XZ plane;

wherein the first concave section comprises a radius of curvature (R3), the convex section comprises a convex section radius of curvature (R4), the second concave section comprises a radius of curvature (R5);

wherein the sole curvature profile further comprises a nadir;

wherein the nadir represents a point of the sole curvature profile that is closest to the XZ plane;

wherein the nadir is located on the convex section;

wherein the strike face forms a crown return such that the crown return extends rearward from the front end and forms a portion of the crown;

the crown return comprises a face-crown transition profile having a face-crown transition radius (R6)

the crown return comprises a crown transition point defined where the face-crown transition profile departs of from the face-crown transition radius (R6);

the crown return comprises a return section radius of curvature (R7); the crown comprising a crown radius of curvature (R8);

a return transition point defined where the return section radius of curvature (R7) transitions to the crown radius of curvature (R8);

a crown return plane extending in a heel-to-toe direction and intersecting the crown transition point and the return transition point;

a reference plane parallel to the ground plane and intersecting the crown transition point; and a draft angle measured between the crown return plane and the reference plane, wherein:

the draft angle is between 0 degrees and −10 degrees.

2. The golf club head of claim 1, wherein the face-crown transition radius (R6) is less than 0.50 inches.

3. The golf club head of claim 1, wherein the return section radius of curvature (R7) is at least than 5.0 inches.

4. The golf club head of claim 1, defining a return transition point depth ratio defined as a depth of the return transition point to an overall depth of the golf club head; wherein the return transition point depth ratio is greater than 0.10.

5. The golf club head of claim 1, wherein the golf club head comprises a crown radius of curvature (R8) of at least 5 inches.

6. The golf club head of claim 1, the golf club head comprising a crown-sole radii curvature ratio defined as the crown radius of curvature (R8) over the convex section radius of curvature (R4);

wherein the crown-sole radii curvature ratio is greater than 1.5.

7. The golf club head of claim 1, further comprising a plurality of ribs located on an internal surface of the sole.

8. The golf club head of claim 7, wherein two or more of the plurality of ribs form a radial pattern.

9. The golf club head of claim 7, wherein one of the plurality of ribs comprises a cross rib extending in a heel-to-toe direction across the internal surface.

10. The golf club head of claim 9, wherein the cross rib intersects one or more of the plurality of ribs.

11. The golf club head of claim 9, wherein the cross rib is located within 0.30 inches of the nadir.

12. The golf club head of claim 9, wherein the cross rib is located at the nadir.

13. The golf club head of claim 7, wherein a height of at least one rib of the plurality of ribs varies along a length of the at least one rib.

14. The golf club head of claim 1, further comprising a slot located on sole;

wherein the slot is defined as an aperture through the sole such that the slot provides access to the hollow interior cavity of the golf club head; and wherein the slot extends in a heel to toe direction.

15. The golf club head of claim 14, wherein the slot is located forward of the first inflection point and rearward of a leading edge of the golf club head.

16. The golf club head of claim 14, wherein the slot comprises a length measured in a direction from heel to toe; wherein the length is between 30 mm and 70 mm.

17. The golf club head of claim 16, wherein the slot comprises a forward edge and a rear edge located rearward of the forward edge; wherein the forward edge is spaced a distance between 3 mm to 15 mm away from a leading edge of the golf club head.

18. The golf club head of claim 17, wherein the slot comprises a depth measured from the forward edge of the slot to the rear edge of the slot; wherein the depth is between 4 mm and 7 mm.

* * * * *